US011890499B2

(12) United States Patent
LoDuca et al.

(10) Patent No.: US 11,890,499 B2
(45) Date of Patent: Feb. 6, 2024

(54) EXERCISE SYSTEM

(71) Applicant: Offset Ventures, LLC, Whitestone, NY (US)

(72) Inventors: Salvatore LoDuca, Great Neck, NY (US); Matthew Fisher, Marysville, PA (US)

(73) Assignee: Offset Ventures, LLC, Whitestone, NY (US)

( * ) Notice: Subject to any disclaimer, the term of this patent is extended or adjusted under 35 U.S.C. 154(b) by 0 days.

(21) Appl. No.: 18/129,648

(22) Filed: Mar. 31, 2023

(65) Prior Publication Data

US 2023/0241448 A1 Aug. 3, 2023

Related U.S. Application Data

(63) Continuation-in-part of application No. 17/972,486, filed on Oct. 24, 2022, which is a continuation of (Continued)

(51) Int. Cl.
*A63B 21/00* (2006.01)
*A63B 21/062* (2006.01)

(52) U.S. Cl.
CPC ..... *A63B 21/156* (2013.01); *A63B 21/063* (2015.10); *A63B 21/4029* (2015.10); *A63B 21/4035* (2015.10); *A63B 21/4043* (2015.10)

(58) Field of Classification Search
CPC . A63B 24/00; A63B 24/0003; A63B 24/0075; A63B 24/0078; A63B 24/0081; (Continued)

(56) References Cited

U.S. PATENT DOCUMENTS 4,828,257 A 5/1989 Dyer
6,117,049 A * 9/2000 Lowe ..... A63B 21/0628 482/4

(Continued)

FOREIGN PATENT DOCUMENTS

WO 2022093459 5/2022

OTHER PUBLICATIONS

International Search Report and Written Opinion, International Application No. PCT/US2021/052207, dated Jan. 11, 2022.

*Primary Examiner* — Andrew S Lo
*Assistant Examiner* — Andrew M Kobylarz
(74) *Attorney, Agent, or Firm* — Akerman LLP

(57) ABSTRACT

According to one example, an exercise system includes a vertical housing, a first weight system coupled to a first upper weighted touchpoint, a second weight system coupled to a second upper weighted touchpoint, a third weight system coupled to a first lower weighted touchpoint, and a fourth weight system coupled to a second lower weighted touchpoint. The exercise system further includes a control system that is configured to cause the first weight system to provide weight to the first upper weighted touchpoint independent of each of the second, third, and fourth weight systems, and cause the third weight system to provide weight to the first lower weighted touchpoint independent of each of the first, second, and fourth weight systems. The first upper weighted touchpoint and the first lower weighted touchpoint may allow the user to exercise the first arm and the first leg of the user simultaneously.

19 Claims, 9 Drawing Sheets

Related U.S. Application Data application No. 17/486,336, filed on Sep. 27, 2021, now Pat. No. 11,478,676, which is a continuation-in-part of application No. 17/083,724, filed on Oct. 29, 2020, now Pat. No. 11,130,022.

(58) Field of Classification Search
CPC ..... A63B 21/4029; A63B 2225/09; A63B 21/156; A63B 21/063; A63B 21/4035; A63B 21/4043
See application file for complete search history.

(56) References Cited

U.S. PATENT DOCUMENTS

| | | | | |
|---|---|---|---|---|
| 7,063,644 | B2 * | 6/2006 | Albert | A63B 24/0062 482/8 |
| 7,722,509 | B2 * | 5/2010 | Eder | A63B 21/156 482/99 |
| 7,892,155 | B2 * | 2/2011 | Pearson | A63B 21/4047 482/121 |
| 11,130,022 | B1 | 9/2021 | Loduca et al. | |
| 11,478,676 | B2 | 10/2022 | Loduca et al. | |
| 2008/0300116 | A1 * | 12/2008 | Eder | A63B 21/063 482/100 |
| 2015/0335950 | A1 * | 11/2015 | Eder | A63B 22/0605 482/8 |
| 2017/0319941 | A1 * | 11/2017 | Smith | A63B 21/06 |
| 2019/0076691 | A1 * | 3/2019 | Smith | A63B 23/1209 |
| 2020/0254295 | A1 | 8/2020 | Watterson | |
| 2020/0360764 | A1 * | 11/2020 | Smith | A61H 1/00 |
| 2023/0040447 | A1 | 2/2023 | Loduca et al. | |

* cited by examiner

EXERCISE SYSTEM

CROSS-REFERENCE TO RELATED APPLICATIONS

This application is a continuation-in-part application claiming the benefit of the filing date under 35 U.S.C. § 120 of U.S. patent application Ser. No. 17/972,486, filed Oct. 24, 2022, which is a continuation application of U.S. patent application Ser. No. 17/486,336, filed Sep. 27, 2021, now U.S. Pat. No. 11,478,676, which is a continuation-in-part application of U.S. patent application Ser. No. 17/083,724, filed Oct. 29, 2020, now U.S. Pat. No. 11,130,022, each of which is incorporated herein by reference in their entirety.

TECHNICAL FIELD

The present disclosure is related to exercise machines and exercise routines, and more specifically to exercise machines and exercise routines that utilize randomization and/or offset loading.

BACKGROUND

Traditionally, a person has used an exercise machine, free weights, and/or their own body weight to perform a workout. These traditional workout methods, however, may be deficient.

SUMMARY

According to one example, an exercise system includes a base, a vertical housing extending vertically outward from the base, a first weighted touchpoint moveably coupled to the vertical housing, a second weighted touchpoint moveably coupled to the vertical housing, and one or more weight systems configured to provide weight to the weighted touchpoints. The exercise system further includes a control system that determines randomized or non-randomized workouts that include a selection of a muscle group, a weight amount, a weight differential, a number of sets of the exercise, and/or a number of repetitions in the set. The control system may also cause the weight system to adjust the weight of the weighted touchpoints based on the workout.

According to another example, an exercise system includes a base, a vertical housing extending vertically outward from the base, and a plurality of weighted touchpoints moveably coupled to the vertical housing. The plurality of weighted touchpoints includes a first weighted touchpoint moveably coupled to a first side of the vertical housing, and a second weighted touchpoint moveably coupled to a second side of the vertical housing. The system further includes one or more weight systems coupled to the plurality of weighted touchpoints, and that are configured to provide weight to the plurality of weighted touchpoints. The system also includes a control system. For a first workout for a user, the control system may determine a first randomized workout for a muscle group of a user, and may cause the one or more weight systems to provide a first heavier weight to the first weighted touchpoint for a first exercise and may further cause the one or more weight systems to provide a first lighter weight to the second weighted touchpoint for the first exercise, where the first heavier weight and the first lighter weight have a first weight differential. For a subsequent workout for the user, the control system may determine a second randomized workout for the same muscle group of the user, and may cause the one or more weight systems to provide a second heavier weight to the first weighted touchpoint for the first exercise and may further cause the one or more weight systems to provide a second lighter weight to the second weighted touchpoint for the first exercise, where the second heavier weight and the second lighter weight have a second weight differential. The first weight differential may be different from the second weight differential, or the first heavier weight may be different from the second heavier weight and the first lighter weight may be different from the second lighter weight.

According to a further example, an exercise system includes a base, a vertical housing extending vertically outward from the base, and a plurality of weighted touchpoints coupled to the vertical housing. The plurality of weighted touchpoints include a first weighted touchpoint coupled to a first side of the vertical housing, and a second weighted touchpoint coupled to a second side of the vertical housing. The exercise system further includes one or more weight systems coupled to the plurality of weighted touchpoints, and that are further configured to provide weight to the plurality of weighted touchpoints. The exercise system also includes a control system configured to select a random weight amount for an exercise to be performed by a user. The control system is also configured to cause the one or more weight systems to provide a first weight to the first weighted touchpoint based on the selected random weight amount, and further cause the one or more weight systems to provide a second weight to the second weighted touchpoint based on the selected random weight amount.

In order to select the random weight amount for the exercise to be performed by the user, the control system may be configured to randomly select the first weight to be provided to the first weighted touchpoint, and randomly select the second weight to be provided to the second weighted touchpoint. In order to select the random weight amount for the exercise to be performed by the user, the control system may be configured to randomly select a weight differential for the user, select the first weight to be provided to the first weighted touchpoint based on the randomly selected weight differential, and select the second weight to be provided to the second weighted touchpoint based on the randomly selected weight differential. The first weight may be heavier than the second weight, lighter than the second weight, or the same weight as the second weight.

According to another example, a method includes selecting offset loading for a first exercise performed on an exercise system. The method further includes selecting a first heavier weight to be provided to a first weighted touchpoint that is coupled to a vertical housing of the exercise system and that is configured to allow a user to exercise one or more muscles on a first side of the user. The method also includes selecting a second lighter weight to be provided to a second weighted touchpoint that is coupled to the vertical housing of the exercise system and that is configured to allow the user to exercise one or more muscles on a second side of the user. The method further includes determining that the user wants to perform the exercise using both the first weighted touchpoint and the second weighted touchpoint. The method also includes, in response to the determination, causing a first weight system of the exercise system to automatically provide the first heavier weight to the first weighted touchpoint, and causing a second weight system of the exercise system to automatically provide the second lighter weight to the second weighted touchpoint. One or more (or all) of the steps of the method may be performed by a control system of the exercise system.

According to a further example, an exercise system includes a vertical housing, a first weighted touchpoint coupled to the vertical housing and configured to allow a user to exercise one or more muscles on a first side of the user, and a first weight system coupled to the first weighted touchpoint. The first weight system is configured to provide weight to the first weighted touchpoint. The exercise system also includes a second weighted touchpoint coupled to the vertical housing and configured to allow the user to exercise one or more muscles on a second side of the user, and a second weight system coupled to the second weighted touchpoint. The second weight system is configured to provide weight to the second weighted touchpoint. Also, the second weight system is separate from the first weight system. The exercise system further includes a control system configured to cause the first weight system to automatically provide a first heavier weight to the first weighted touchpoint for a first exercise and further cause the second weight system to automatically provide a second lighter weight to the second weighted touchpoint for the first exercise.

According to another example, an exercise system includes a base, a vertical housing extending vertically outward from the base, a first upper weighted touchpoint coupled to the vertical housing and configured to allow a user to exercise a first arm of the user, a first weight system coupled to the first upper weighted touchpoint and configured to provide weight to the first upper weighted touchpoint, a second upper weighted touchpoint coupled to the vertical housing and configured to allow the user to exercise a second arm of the user, a second weight system coupled to the second upper weighted touchpoint and configured to provide weight to the second upper weighted touchpoint, a first lower weighted touchpoint coupled to the vertical housing and configured to allow the user to exercise a first leg of the user, a third weight system coupled to the first lower weighted touchpoint and configured to provide weight to the first lower weighted touchpoint, a second lower weighted touchpoint coupled to the vertical housing and configured to allow the user to exercise a second leg of the user, and a fourth weight system coupled to the second lower weighted touchpoint and configured to provide weight to the second lower weighted touchpoint. Each of the first, second, third, and fourth weight systems is a separate weight system. The exercise system further includes a user bench having a leg attachment configured to allow the user to exercise the first leg of the user and further configured to allow the user to exercise the second leg of the user. The first lower weighted touchpoint and the second lower weighted touchpoint are configured to be coupled to the leg attachment. The exercise system further includes a control system. The control system is configured to cause the first weight system to provide a first weight to the first upper weighted touchpoint independent of each of the second, third, and fourth weight systems, cause the second weight system to provide a second weight to the second upper weighted touchpoint independent of each of the first, third, and fourth weight systems, cause the third weight system to provide a third weight to the first lower weighted touchpoint independent of each of the first, second, and fourth weight systems, and cause the fourth weight system to provide a fourth weight to the second lower weighted touchpoint independent of each of the first, second, and third weight systems.

In some examples, the first upper weighted touchpoint and the first lower weighted touchpoint are configured to allow the user to exercise the first arm of the user and the first leg of the user simultaneously. In other examples, the first upper weighted touchpoint, the first lower weighted touchpoint, and the second lower weighted touchpoint are configured to allow the user to exercise the first arm of the user, the first leg of the user, and the second leg of the user simultaneously. In further examples, the first upper weighted touchpoint, the second upper weighted touchpoint, and the first lower weighted touchpoint are configured to allow the user to exercise the first arm of the user, the second arm of the user, and the first leg of the user simultaneously. In additional examples, the first upper weighted touchpoint, the second upper weighted touchpoint, the first lower weighted touchpoint, and the second lower weighted touchpoint are configured to allow the user to exercise the first arm of the user, the second arm of the user, the first leg of the user, and the second leg of the user simultaneously.

According to a further example, a method includes determining, by a control system of an exercise system, a first weight and a second weight to be used by a user to exercise a first arm of the user and a first leg of the user simultaneously. The exercise system includes a first upper weighted touchpoint configured to allow the user to exercise the first arm of the user, a first weight system coupled to the first upper weighted touchpoint and configured to provide weight to the first upper weighted touchpoint, a second upper weighted touchpoint configured to allow the user to exercise a second arm of the user, a second weight system coupled to the second upper weighted touchpoint and configured to provide weight to the second upper weighted touchpoint, a first lower weighted touchpoint configured to allow the user to exercise the first leg of the user, a third weight system coupled to the first lower weighted touchpoint and configured to provide weight to the first lower weighted touchpoint, a second lower weighted touchpoint configured to allow the user to exercise a second leg of the user, and a fourth weight system coupled to the second lower weighted touchpoint and configured to provide weight to the second lower weighted touchpoint. Each of the first, second, third, and fourth weight systems is a separate weight system. The method further includes, following the determination of the first weight and the second weight to be used by the user to exercise the first arm of the user and the first leg of the user simultaneously: causing, by the control system, the first weight system to provide the first weight to the first upper weighted touchpoint independent of each of the second, third, and fourth weight systems, and causing, by the control system, the third weight system to provide the second weight to the first lower weighted touchpoint independent of each of the first, second, and fourth weight systems. The method also includes allowing the user to utilize the first upper weighted touchpoint and the first lower weighted touchpoint simultaneously so as to exercise the first arm of the user and the first leg of the user simultaneously.

BRIEF DESCRIPTION OF THE DRAWINGS

For a more complete understanding of the present disclosure and its features and advantages, reference is now made to the following description, taken in conjunction with the accompanying drawings, in which.

DESCRIPTION

Embodiments of the present disclosure are best understood by referring to FIGS. 1A-4 of the drawings, like numerals being used for like and corresponding parts of the various drawings.

According to the examples illustrated in FIGS. 1A-4, the exercise system 10 may provide an exercise machine or device that can automatically adjust the weight lifted by a user after each exercise, after each set in an exercise, and/or after each repetition in an exercise. This automatic adjustment of weights may include an automatic adjustment of offset loaded weights, where the weight may be heavier on one side of the body than on the other side of the body. The exercise system 10 may further generate workouts that are randomized. These randomized workouts may be created so as to be different from the previous workout. As an example of this, the exercises in the workout may be randomized by muscle group, weight amount, weight differential, number of sets of the exercise, number of repetitions in the set, any other manner, or any combination of the preceding. Preferably, for each session for a particular muscle group, the user will not be experiencing the same consecutive routine. In some examples, the exercise system 10 may generate workouts that are not randomized.

Figure 1B:
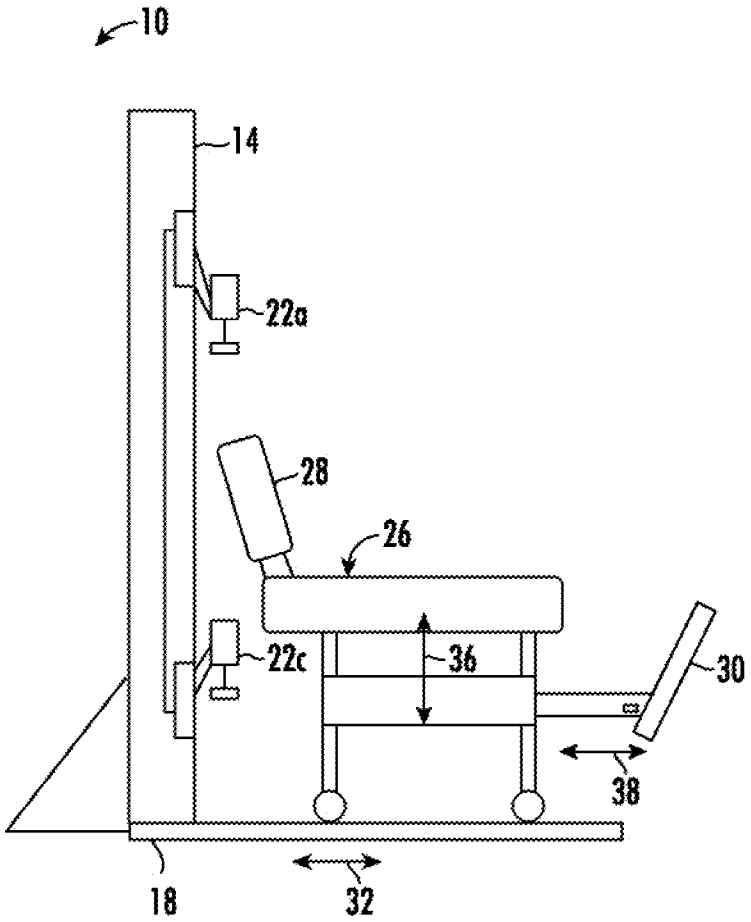
FIG. 1B is a side view of the exercise system of FIG. 1A.
Figure 1A:
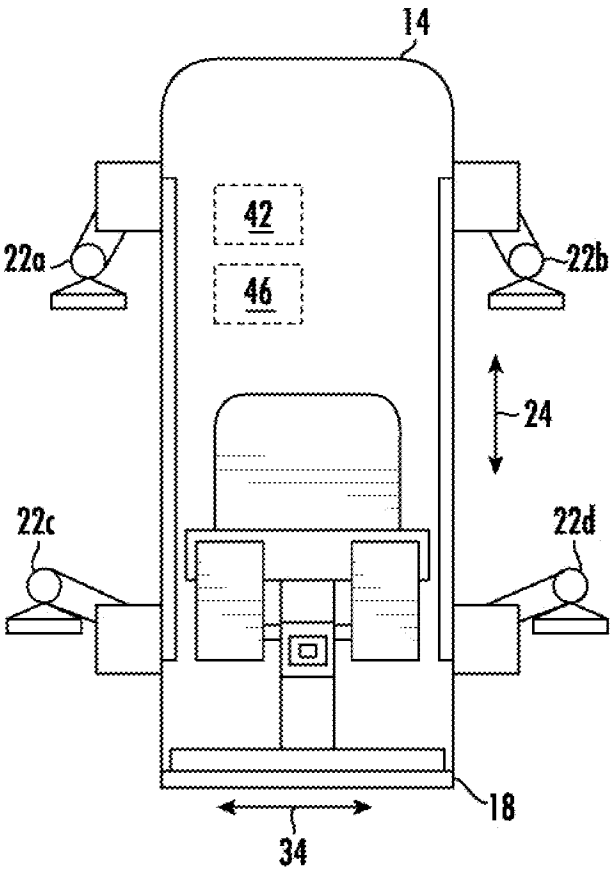
FIG. 1A is a front view of one example of an exercise system.
Figure 1C:
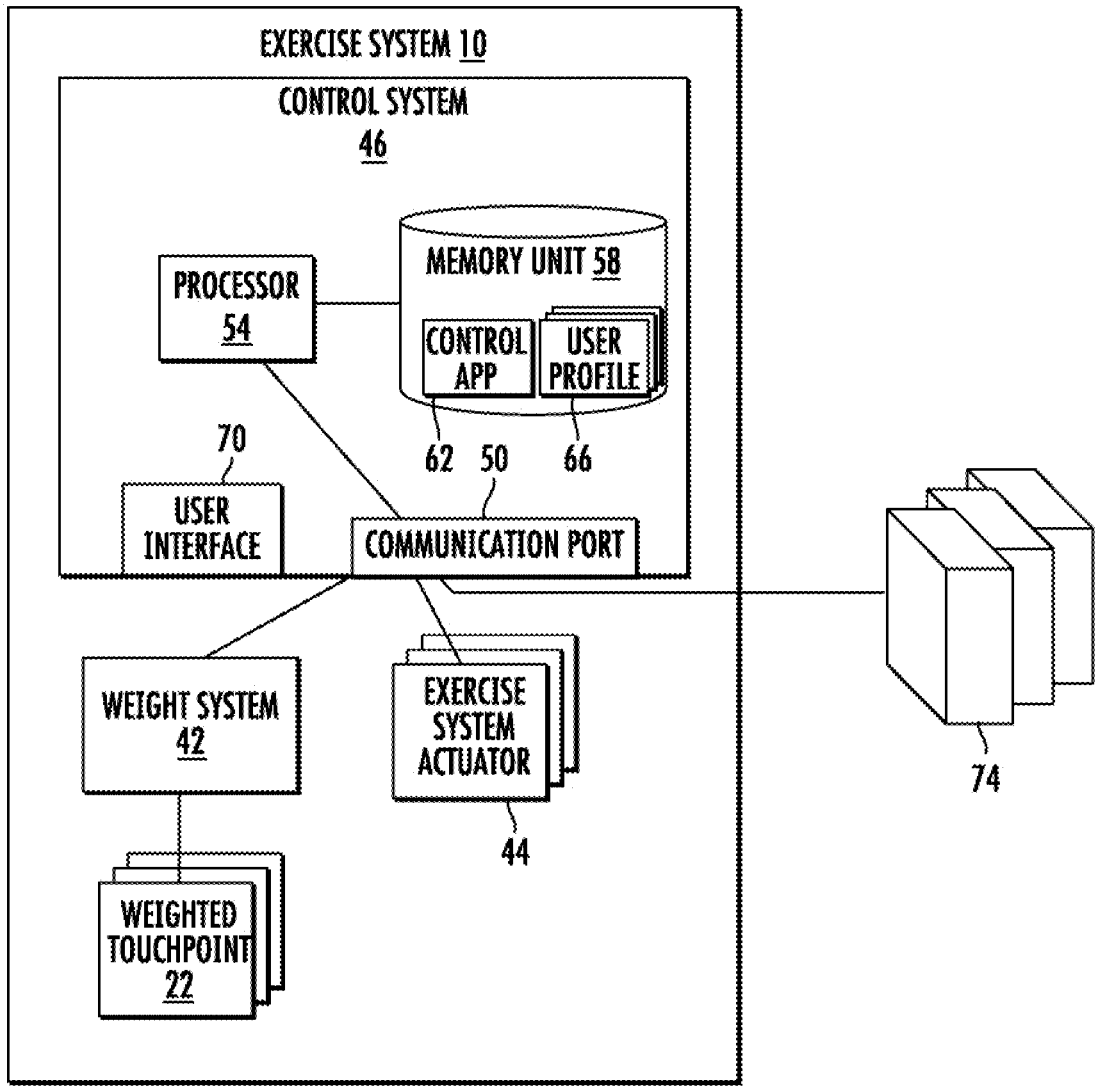
FIG. 1C schematically illustrates one example of a control system of the exercise system.

With reference to FIGS. 1A-1C, in various examples, the exercise system 10 includes a vertical housing 14 that extends vertically outward from a base 18, one or more weighted touchpoints 22 moveably coupled to the vertical housing 14, and a user bench 26 moveably coupled to the base 18.

The vertical housing 14 may hold the weighted touchpoint(s) 22 that may be used by a user to perform an exercise. Furthermore, the vertical housing 14 may enclose (fully or partially) one or more additional components of the exercise system 10. For example, as is discussed below, the vertical housing 14 may enclose (fully or partially) a weight system 42 and a control system 46. By enclosing these components, the vertical housing 14 may protect the components. For example, the vertical housing 14 may protect that components from being accidentally hit or touched (e.g., by a user working out), from being sprayed with liquids (e.g., water, sweat), or from any other foreign substance (e.g., sand, dirt) or force.

The vertical housing 14 extends vertically outward from the base 18. The vertical housing 14 may vertically extend to any height, such as a height of 5 feet, 6 feet, 7 feet, 8 feet, 9 feet, or any other height. The vertical housing 14 may be made of any material that may provide protection to the components enclosed within the vertical housing 14. For example, the vertical housing 14 may be made of steel, aluminum, any other metal, or any combination of the preceding.

Figure 2A:
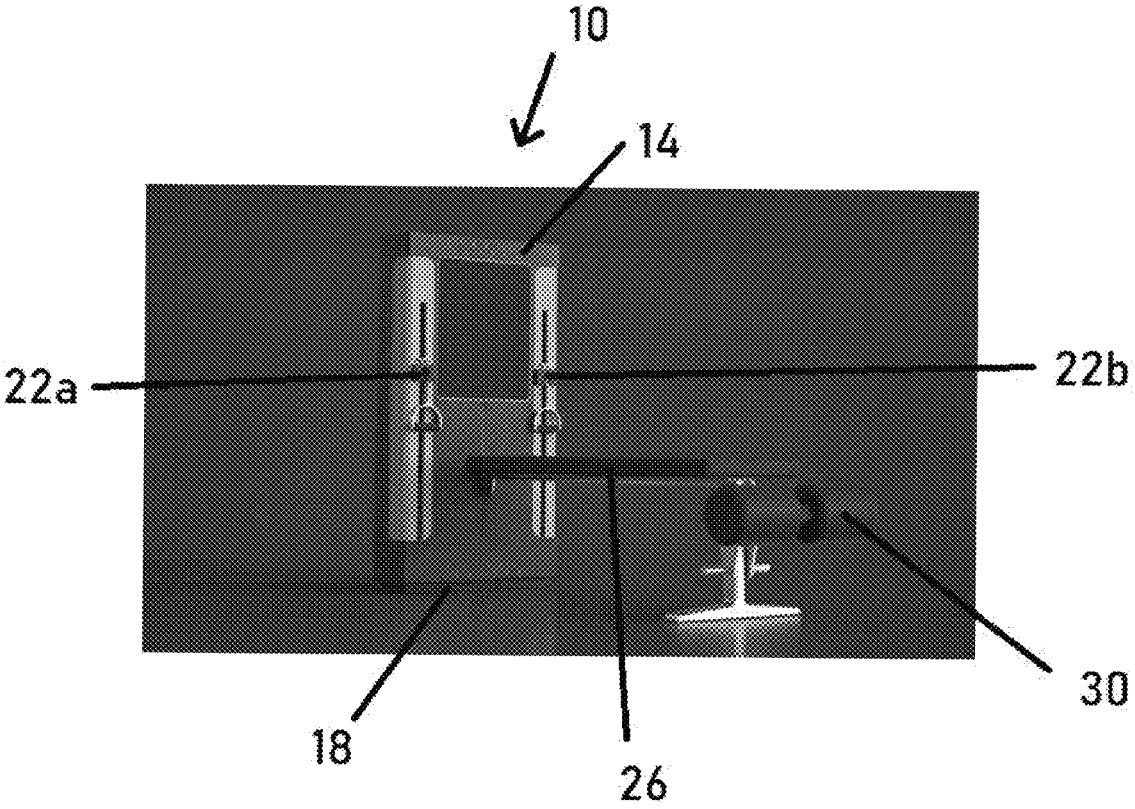
FIG. 2A is a front perspective view of another example of an exercise system.
Figure 2B:
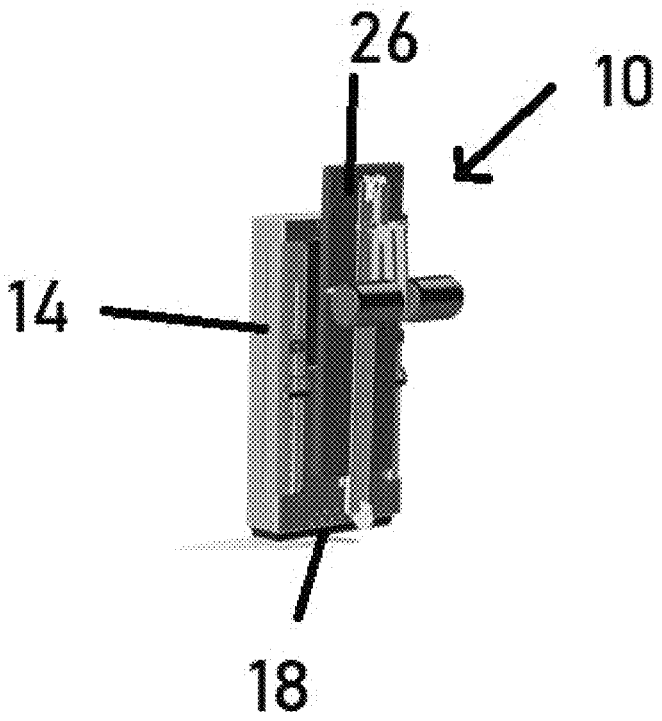
FIG. 2B is a front perspective view of the exercise system of FIG. 2A with the user bench folded up.
Figure 2C:
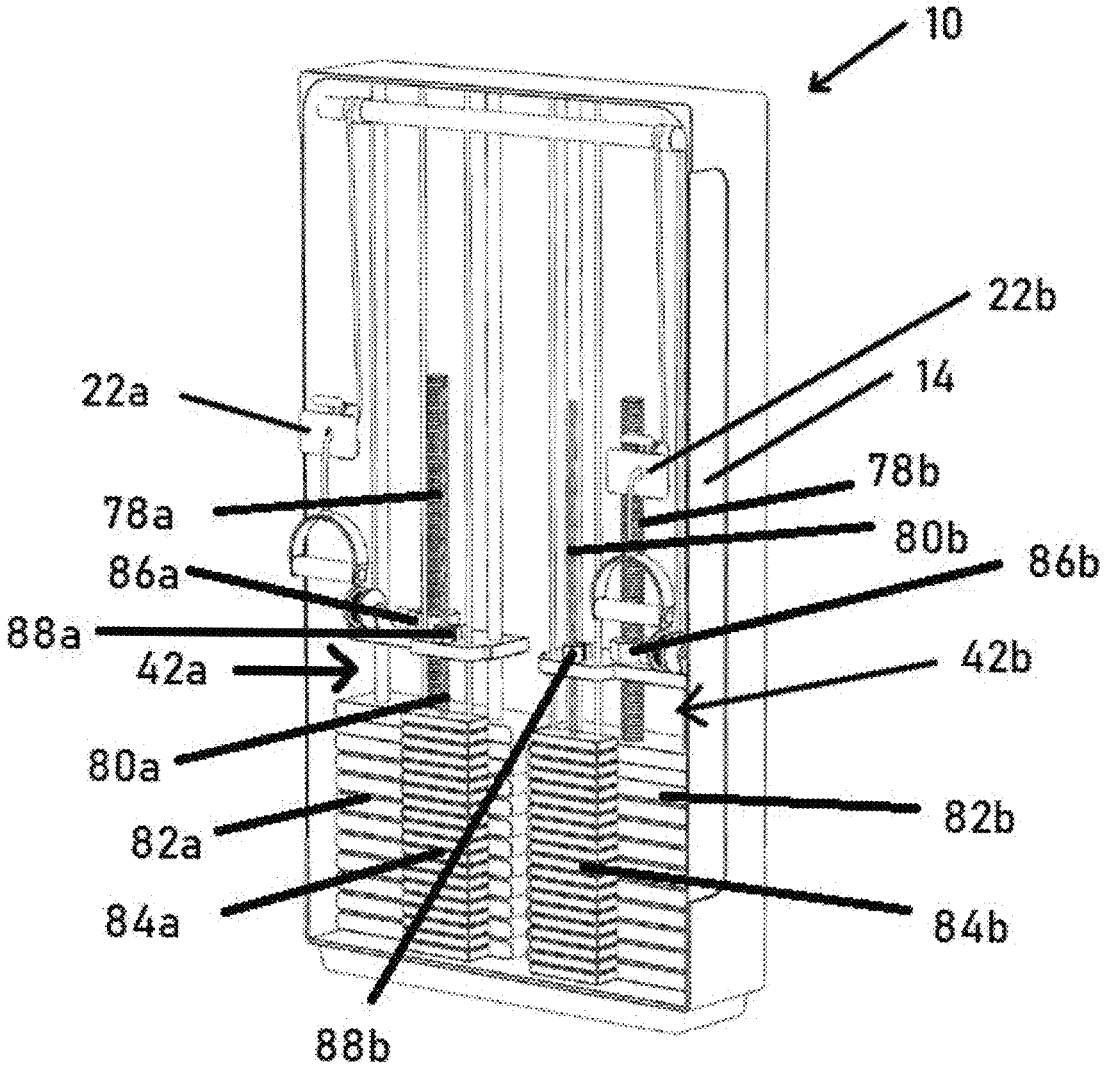
FIG. 2C is another front perspective view of the exercise system of FIG. 2A with the front panel removed.

The base 18 may provide a stable platform for mounting the vertical housing 14 and the user bench 26. As such, the base 18 may provide stability to the exercise system 10, so as to prevent the vertical housing 14 from tipping over. Furthermore, the base 18 may also provide a footprint within which the user may exercise on the exercise system 10. This footprint may be large enough to provide space for the user to work out in, and may prevent other machines from being positioned in an area that encroaches on the user working out. The base 18 may have any length and/or width. For example, the base 18 may have a length of 5 feet, 6 feet, 7 feet, 8 feet, 9 feet, or any other length. As another example, the base 18 may have a width of 5 feet, 6 feet, 7 feet, or any other width. In some examples, the base 18 may have a length and/or width that is the same length and/or width as (or a smaller length and/or width than) the vertical housing 14. FIGS. 2A-2C illustrate an example where the base 18 has a length and/or width that is smaller than the length and/or width of the vertical housing 14. The base 18 may be made of any material that may provide a stable platform. For example, the base 18 may be made of steel, aluminum, any other metal, or any combination of the preceding.

The weighted touchpoint(s) 22 may be any device or structure that may be used by a user to perform one or more exercises. For example, the weighted touchpoint(s) 22 may be pulley devices, movable arms (e.g., bench press arms, incline press arms, hammer strength arms, pec deck arms, leg curl arms, leg extension arms), cardio equipment (e.g., elliptical paddles, stair steppers), any other device or structure that may provide weight for a workout, any other device or structure that may be used by a user to perform one or more exercises, or any combination of the preceding. As is illustrated in FIGS. 1A and 1B, the weighted touchpoints 22 are pulley devices. Each pulley device may include a handle and a cable. The handle may be attached (e.g., via a clip) to a first end of the cable, and the second end of the cable may extend into the vertical housing 14, and may be attached to a weight system 42 that provides weight (e.g., via resistance). In some examples, the handles may be removed and replaced with one or more bars (or other devices or structures). In other examples, the handles may be removed and the cables may then be attached to portions of the user bench 26 (discussed below). As such, a user may interchange equipment that is attached to the cables of the pulley device, so as to add, upgrade, or remove features.

The weighted touchpoints 22 may be positioned on the vertical housing 14, thereby allowing a user to access the weighted touchpoints 22. The weighted touchpoints 22 may be positioned on the vertical housing 14 in any manner. For example, the weighted touchpoints 22 may be moveably attached to the vertical housing 14. This moveable attachment may allow the weighted touchpoints 22 to be moved vertically along the height of the vertical housing 14. This vertical movement is illustrated as double arrow 24. The vertical movement may allow the height of any weighted touchpoint 22 to be adjusted. This adjustment may be used to change to a different exercise type (e.g., move from a seated row to a latissimus dorsi muscle ("lat") pull-down), to change to a user with a different height (e.g., move from a first user with a height of 6 feet, 2 inches to a second user with a height of 5 feet, 1 inch), or any other reason. The weighted touchpoints 22 may be positioned on any portion of the vertical housing. For example, as is illustrated, the weighted touchpoints 22 are positioned on the sides (i.e., left side and right side) of the vertical housing 14. This positioning allows a weighted touchpoint 22 (e.g., weighted touchpoint 22*a*) to be used to exercise muscle(s) on a first side of the user's body (e.g., the left side), and further allows another weighted touchpoint 22 (e.g., weighted touchpoint 22*b*) to be used to exercise muscle(s) on a second opposite side of the user's body (e.g., the right side). Also, the positioning of a weighted touchpoint 22 on a side of the vertical housing 14 does not require the weighted touchpoint 22 to be positioned exactly on the "side" of the vertical housing 14. Instead, the positioning of a weighted touchpoint 22 on a side of the vertical housing 14 refers to any positioning on the vertical housing 14 that is closer to that side than an opposite side. For example, a weighted touchpoint 22 positioned on the left side of housing 14 may refer to a weighted touchpoint 22 positioned on the front (or back) of the vertical housing 14 in a location that is left of the middle point on the front (or back) of the vertical housing 14, and a weighted touchpoint 22 positioned on the right side of housing 14 may refer to a weighted touchpoint 22 positioned on the front (or back) of the vertical housing 14 in a location that is right of the middle point on the front (or back) of the vertical housing 14. An example of such positioning is illustrated in FIGS. 2A-2C, where a weighted touchpoint 22*a* is positioned on the left side of the vertical housing 14 by being positioned on the front of the vertical housing 14 in a location that is left of the middle point on the front of the vertical housing 14, and where a weighted touchpoint 22*b* is positioned on the right side of the vertical housing 14 by being positioned on the front of the vertical housing 14 in a location that is right of the middle point on the front of the vertical housing 14.

The weighted touchpoints 22 may be moveably attached to the vertical housing 14 in any manner that allows them to move vertically. For example, as is illustrated in FIGS. 1A and 1B, the weighted touchpoints 22 are attached to the vertical housing 14 via a rail system that allows each weighted touchpoint 22 to be individually moved along the vertical axis (double arrow 24). The weighted touchpoint 22 may be moved along the vertical axis manually by a user, automatically (e.g., robotically driven) by the control system 46, or a combination of the preceding.

In other examples, the weighted touchpoints 22 may not be moveably attached to vertical housing 14. In such examples, the weighted touchpoints 22 may be fixedly attached to the vertical housing 14. This fixed attachment may prevent the weighted touchpoints 22 from being moved along the vertical axis (so as to adjust the height of the weighted touchpoints 22).

The exercise system 10 may include any number of weighted touchpoints 22. For example, the exercise system 10 may include one weighted touchpoint 22, two weighted touchpoints 22, three weighted touchpoints 22, four weighted touchpoints 22, five weighted touchpoints 22, six weighted touchpoints 22, more than six weighted touchpoints 22, or any other number of weighted touchpoints 22. As is illustrated in FIGS. 1A-1B, the exercise system 10 includes four weighted touchpoints 22 (i.e., 22*a*, 22*b*, 22*c*, and 22*d*).

A weighted touchpoint 22 may be an upper weighted touchpoint 22 that is used predominately for arm exercises. In the illustrated example, the exercise system 10 include two upper weighted touchpoints 22*a* and 22*b*. In other examples, the exercise system 10 may include any other number of upper weighted touchpoints 22, such as no upper weighted touchpoints 22, one upper weighted touchpoint 22, or three or more upper weighted touchpoints 22. In operation, a user may utilize a pushing motion on these two upper weighted touchpoints 22*a* and 22*b* to perform an exercise similar to a chest press (e.g., a chest press machine), and may further utilize a pulling motion on these two upper weighted touchpoints 22*a* and 22*b* to perform an exercise similar to a row (e.g., a rowing machine motion, seated row motion) and/or to perform an exercise similar to a lat pull-down (e.g., overhead pulldown bar motion).

A weighted touchpoint 22 may be a lower weighted touchpoint 22 that is used predominately for leg exercises. In the illustrated example, the exercise system 10 includes two lower weighted touchpoints 22*c* and 22*d*. In other examples, the exercise system 10 may include any other number of lower weighted touchpoints 22, such as no lower weighted touchpoints 22, one lower weighted touchpoint 22, or three or more lower weighted touchpoints 22. In operation, a user may utilize a pushing motion on these two lower weighted touchpoints 22*c* and 22*d* to perform an exercise similar to a leg press (e.g., a leg press machine motion), and may further utilize a pulling motion on these two lower weighted touchpoints 22*c* and 22*d* to perform an exercise similar to a ham string curl (e.g., a hamstring curl machine motion).

The user bench 26 may hold a user (or a portion of the user) while the user is performing one or more exercises with the exercise system 10. The user bench 26 may be a chair, a seat, a horizontal bench, an incline/decline bench, any other structure that may hold a user (or a portion of the user) while the user is performing one or more exercises with the exercise system 10, or any combination of the preceding.

As is illustrated, the user bench 26 may include a back support structure 28 and/or a leg attachment 30. The back support structure 28 may support the back of a user while the user is performing one or more exercises with the exercise system 10. The leg attachment 30 may support the legs of a user while the user is performing one or more exercises with the exercise system 10. Additionally, in some examples, the leg attachment 30 may be used for various leg-based exercises. For example, the leg attachment 30 may be a leg press attachment that allows for leg presses, a leg extension attachment that allows for leg extensions, a leg curl attachment that allows for leg curls, any other leg workout attachment, or any combination of the preceding. To provide weight for these leg-based exercises, one or more of the weighted touchpoints 22 may be attached to the leg attachment 30. As an example of this, the handle may be removed from the pulley device of the lower weighted touchpoints 22*c* and 22*d*, and then the cable of the lower weighted touchpoints 22*c* and 22*d* may be attached to the leg attachment 30.

The user bench 26 may be positioned on the base 18, as is illustrated in FIGS. 1A-1B. The user bench 26 may be positioned on the base 18 in any manner. For example, the user bench 26 may be moveably attached to the base 18. This moveable attachment may allow the weighted user bench 26 to be moved horizontally along the length of the base 18 (as is shown by double arrow 32 in FIG. 1B), moved horizontally along the width of the base 18 (as is shown by double arrow 34 in FIG. 1A), or any combination of the preceding. The user bench 26 may be moveably attached to the base 18 in any manner that allows the user bench 26 to move horizontally along the length of the base 18 and/or along the width of the base 18. For example, the user bench 26 may be moveably attached to the base 18 by a rail system, a wheel and track system, or any other moveable attachment. The user bench 26 may be moved along the horizontal length and/or horizontal width manually by a user, automatically (e.g., robotically driven) by the control system 46, or a combination of the preceding. These adjustments may be used to change to a different exercise type, to change to a user with a different height (e.g., move from a first user with a height of 6 feet, 2 inches to a second user with a height of 5 feet, 1 inch), or any other reason. In other examples, the user bench 26 may not be moveably attached to base 18. In such examples, the user bench 26 may be fixedly attached to the base 18. This fixed attachment may prevent the user bench 26 from being moved along the horizontal axes in relation to the base 18. In other examples, the user bench 26 may be positioned on the vertical housing 14 (instead of the base 18). FIGS. 2A-2B illustrate one example of the user bench 26 positioned on the vertical housing 14 by a moveable attachment to the vertical housing 14.

The user bench 26 may be moved vertically in relation to the base 18 (and/or the vertical housing 14). An example of this vertical movement is illustrated in FIG. 1B as double arrow 36. The user bench 26 may be moved vertically in relation to the base 18 manually by a user, automatically (e.g., robotically driven) by the control system 46, or a combination of the preceding. The leg attachment 30 of the user bench 26 may be moved horizontally in relation to the vertical housing 14. An example of this horizontal movement is illustrated in FIG. 1B as double arrow 38. The leg attachment 30 of the user bench 26 may be moved horizontally in relation to the vertical housing 14 manually by a user, automatically (e.g., robotically driven) by the control system 46, or a combination of the preceding. These adjustments of the user bench 26 and/or leg attachment 30 may be used to change to a different exercise type, to change to a user with a different height (e.g., move from a first user with a height of 6 feet, 2 inches to a second user with a height of 5 feet, 1 inch), or any other reason.

As is discussed above, the adjustments of the user bench 26 may be automatic (e.g., robotically driven) by the control system 46. To perform these automatic adjustments, the exercise system 10 may include one or more actuators 44 (shown in FIG. 1C) that may move portions of the exercise system 10 when instructed. The exercise system 10 may include a switch, joystick, or any other user interface (e.g., touchscreen) that may allow the user to control when and how the exercise system 10 is adjusted. In some examples, the exercise system 10 may allow the user bench 26 to be adjusted in up to 8 directions (e.g., shown by double arrows 32, 34, 36, and 38). Once the user bench 26 has been adjusted for a particular user, that configuration of the user bench 26 may be saved in a user profile 66 (discussed below) for the user. As such, the user bench 26 may automatically adjust to the saved configuration whenever that user is using the exercise system 10.

The user bench 26 may also be foldable in relation to the base 18 (and/or the vertical housing 14). By being foldable, the user bench 26 may fold upward (in a swinging motion) towards the vertical housing 14, and may further un-fold downward (in a swinging motion) away from the vertical housing 14. The upward folding of the user bench 26 may allow the user bench 26 to be moved off the floor, so as to reduce the footprint of the exercise system 10 when the user bench 26 is not in use. FIGS. 2A-2B illustrate one example of a user bench 26 that is foldable in relation to the base 18 (and/or the vertical housing 14).

The exercise system 10 may also include the weight system 42 that may provide weight (e.g., via resistance) for the weighted touchpoints 22. That is, the weight system 42 may allow the weight of a weighted touchpoint 22 to be adjusted. For example, the weight system 42 may allow a user to perform a first set of bicep curls (using touchpoints 22*a* and 22*b*) at a weight of 20 pounds, and then the weight system 42 may allow that weight to be adjusted so that the user can perform a second set of bicep curls (using touchpoints 22*a* and 22*b*) at a weight of 25 pounds. As such, each weighted touchpoint 22 may be adjustable to any weight. The weight system 42 may further allow the weight of each weighted touchpoint 22 to be adjusted at any time. For example, the weight of a weighted touchpoint 22 may be adjusted after each exercise repetition (e.g., after each bicep curl), after each exercise set (e.g., after a set of ten bicep curls), any other time, or any combination of the preceding.

The weight system 42 may further allow the weight of each weighted touchpoint 22 to be adjusted individually. That is, the weight system 42 may allow the weight for a first weighted touchpoint 22 to be adjusted, while the weight of a second weighted touchpoint 22 is not adjusted. While the weight system 42 may allow for individual weight adjustments for each weighted touchpoint 22, it may also allow weighted touchpoints 22 to be adjusted in sets (or for all of the weighted touchpoints 22 to be adjusted together), in some examples.

The exercise system 10 may have any number of weight systems 42. For example, the exercise system 10 may have a single weight system 42 that may provide weight for all of the weighted touchpoints 22. As another example, the exercise system 10 may include a separate weight system 42 for each weighted touchpoint 22.

The weight system 42 may be any device and/or structure that may provide weight for the weighted touchpoints 22. As one example, the weight system 42 may be a preset weight block system. The preset weight block system may include preset weight blocks that may be used to adjust the weight for the weighted touchpoint(s) 22. In some examples, the preset weight block system may include multiple stacks of preset weight blocks, one for coarse increments and one for more fine (i.e., less than 1 pound, less than 5 pounds) increments. The preset weight block system may be any type of weight block system that utilizes preset weight blocks to adjust the weight. For example, the preset weight block system may be an actuated pin and weights system. This actuated pin and weights system may include actuated pins that may be slotted into preset weight blocks so as to adjust the weight for the weighted touchpoint(s) 22. As another example, the preset weight block system may be a screw and weights system. This screw and weight system may include a screw that is threaded into preset weight blocks so as to adjust the weight for the weighted touchpoint(s) 22. FIG. 2C illustrates one example of a screw and weight system.

As another example, the weight system 42 may be an electromagnetic eddy current resistance system. This system may include a spinning ferromagnetic (e.g., steel) flywheel and an electromagnetic brake that can be used to provide adjustable resistance. The brake may induce eddy currents in the flywheel. As the current increases and decreases, the resistance on the plate changes accordingly. The resistance may be based on flywheel momentum, and may be controlled electrically.

As a further example, the weight system 42 may be a friction resistance system. This system may be similar to the electromagnetic eddy current resistance system. However, this system may include a friction plate (e.g., a serviceable friction plate) and disk. As the disk spins when a force is applied on a weighted touchpoint 22 (e.g., force applied by a user on the handle of the pulley device), more pressure is applied by the friction plate to apply more resistance (thereby simulating greater weight).

As another example, the weight system 42 may be an active-compliance motor system. In this system, the weighted touchpoint 22 may be connected to an axle by a pulley. Furthermore, the axle may be connected to a motor. As the user applies force to the weighted touchpoint 22, the force may cause the axle to rotate in a first direction. The motor, however, may drive the axle in a second opposite direction (thereby resisting the force applied by the user). To increase the weight, a motor driver may drive the motor with a higher current, which may further resist the rotation of the axle by the user. The active-compliance motor system may include a compression load cell to sense when a user is applying force on a weighted touchpoint 22. In another example, a proportional-integral-derivative (PID) sensor or infrared sensor may be used to sense when a user is applying force on a weighted touchpoint 22. A control loop for the motor and gearbox may be used to dictate the speed of rotation at a set torque in the opposite direction of the force applied by the user. If the user lets go of the weighted touchpoint 22 (e.g., the handle slips out of the user's hand), the motor may be capable of ending its rotation without the forces on the load cell.

In addition to providing weight (as is discussed above), the weight system 42 may further be able to measure force, torque, and/or pressure applied by a user on the weighted touchpoints 22. This may allow the exercise system 10 to perform strength tests on a user, as is discussed below. Furthermore, it may also allow the exercise system 10 to track a user's progress during a workout, and to keep track of a user's historical performance.

The weight system 42 may measure force, torque, and/or pressure in any manner. For example, the weight system 42 may include one or more force sensors, load sensors, torque sensors, load cells, strain gauges, and/or pressure sensors. In some examples, the weight system 42 may include a weight actuation and force sensor board which may measure force, torque, and/or pressure. In some examples, the weight actuation and force sensor board may perform low level weight actuation (e.g., motor control, solenoid energizing/de-energizing, etc.) and may measure force input exerted by the user (by way of a load cell or strain gauge, for example). The weight actuation and force sensor board may be capable of limiting the amount of current going to the motors for protection of traces, connectors, and motor safety. The weight actuation and force sensor board may feature current monitoring to provide feedback on motor operating conditions.

The exercise system 10 may also include the control system 46. The control system 46 may control the operations of the exercise system 10. For example, the control system 46 may control the weight that is applied to each weighted touchpoint 22. As another example, the control system 46 may control the vertical position of the weighted touchpoints 22. As a further example, the control system 46 may control the positioning of the user bench 26 and the components of the user bench 26. FIG. 1C schematically illustrates an example of the control system 46 of the exercise system 10. As is illustrated in FIG. 1C, the control system 46 may include a communication port 50, a processor 54, a memory unit 58, and a user interface 70.

Communication port 50 represents any suitable device that may allow communication between the control system 46 and other devices, such as weight system(s) 42, exercise system actuator(s) 44, external storage system 74, or other external devices. Communication port 50 represents any port or connection, real or virtual, including any suitable hardware and/or software, including protocol conversion and data processing capabilities, to communicate through a local area network (LAN), a metropolitan area network (MAN), a wide area network (WAN), or other communication system that allows control system 46 to exchange information with other devices. Communication port 50 may include a receiver, transmitter, transceiver, etc. For example, communication port 50 may comprise a transceiver configured for wired communication, wireless communication, or both. In one example, communication port 50 is configured for communication via Universal Asynchronous Receiver/Transmitter (WART); Recommended Standard 232 (RS-232), Inter-Integrated Circuit (I2C), mobile industry processor interface (MIPI), Serial peripheral interface (SPI), near-field communication (NFC), Ethernet, BLUETOOTH, infrared (IR), Wi-Fi, radio, etc. Communication port 50 may transmit operational data to (and/or receive operational data from) a remote device, such as external storage system 74, a user's Smartphone or other device (e.g., computer), any other remote device, or any combination of the preceding Processor 54 communicatively couples to communication port 50 and memory unit 58, and controls the operation and administration of control system 46 by processing information received from communication port 50, memory unit 58, and user interface 70. Processor 54 includes any hardware and/or software that operates to control and process information. For example, processor 54 executes a control application 62 to control the operation of control system 46, such as to generate a randomized or non-randomized workout for a user, and to adjust the weight amount for various exercises based on the generated workout. Processor 54 may be a programmable logic device, a microcontroller, a microprocessor, any suitable processing device, or any combination of the preceding.

Memory unit 58 stores, either permanently or temporarily, data, operational software, or other information for processor 54. Memory unit 58 includes any one or a combination of volatile or non-volatile local or remote devices suitable for storing information. For example, memory unit 58 may include random access memory (RAM), read only memory (ROM), magnetic storage devices, optical storage devices, any other suitable information storage device, or any combination of the preceding. While illustrated as including particular information, memory unit 58 may include any suitable information for use in the operation of control system 46. As illustrated, memory unit 58 includes the control application 62 and user profile(s) 66.

The control application 62 represents any suitable set of instructions, logic, or code embodied in a computer-readable storage medium and operable to facilitate the operation of control system 46. The control application 62 may generate workout routines for a user. These generated workout routine may be randomized so as to create a workout that is different from the previous workout. As an example of this, the exercises in the workout may be randomized by muscle group, weight amount, weight differential, number of sets of the exercise, number of repetitions in the set, any other manner, or any combination of the preceding. Preferably, for each session for a particular muscle group, the user will not be experiencing the same consecutive routine. To randomize the workouts, the control application 62 (or the control system 46) may include a randomization software package that may prevent the same workout routine for occurring consecutively (or prevent the same workout routine for a particular muscle group from occurring consecutively). The randomization software package may include a random number generator to allow for the randomization of the workout routine. In some examples, the control application 62 may generate non-randomized workout routines for a user. Further examples of the generation of a workout are discussed below.

The control application 62 may further assist a user in performing a workout. For example, when the control application 62 is executed by the processor 54, the processor 54 may activate the weight system 42 so as to change the weight applied to one or more weighted touchpoints 22 (e.g., change the weight of a weighted touchpoint 22). As another example, when the control application 62 is executed by the processor 54, the processor 54 may activate one or more exercise system actuators 44. These actuator(s) 44 may move the weighted touchpoint(s) 22 along the vertical axis so as to position them for a particular user and/or for a particular exercise. The actuator(s) 44 may also adjust the user bench 26 so as to position the user bench 26 (or components of the user bench 26) for a particular user and/or for a particular exercise. The actuator(s) 44 may be any type of device or system that can move one or more portions of the exercise system 10, such as a mechanical actuator, an electro-mechanical actuator, a hydraulic actuator, a pneumatic actuator, or any other device or system that can move one or more portions of the exercise system 10.

The movements and adjustments of the exercise system 10 may be made based on data collected from one or more positional sensors (not shown) included in the exercise system 10. The positional sensors may determine a current position of the weighted touchpoints 22 and/or the user bench 26 and its components. The processor 58 may then utilize this data to cause the actuator(s) 44 to move the weighted touchpoints 22 and adjust the user bench 26. Example positional sensors include a potentiometer, a motor encoder, or any other positional sensor.

A user profile 66 may represent data associated with a particular user of the exercise system 10. The user profile 66 may uniquely identify the particular user, and may allow the control system 46 to generate a workout that is customized to that user. For example, the workout may be generated based on a user's preferences, abilities, and/or past progress, thereby creating a customized workout. Furthermore the user profile 66 may further allow the control system 46 to generate a randomized workout for the user. This may prevent the user from exercising in the same way in consecutive workouts. The user profile 66 may include any information associated with the user. For example, the user profile 66 may include personal data, such gender, age, height, weight, any past or present medical conditions, any past or present exercise experience (e.g., no experience, moderate experience, advanced experience, etc.), any exercise goals (e.g., weight loss amount, maximum weight lift amount), blood pressure, heart rate, any other personal data, or any combination of the preceding. The user profile 66 may further include credentials for identifying and authenticating the user. The user profile 66 may further include the results of one or more strength tests conducted by the user, historical performance statistics for the user, previous workout information (e.g., what exercises were previously performed, and when), any other information related to working out, or any combination of the preceding. The exercise system 10 may include any number of user profiles 66. For example, the exercise system 10 may include a user profile 66 for each user that has ever utilized the exercise system 10 for working out.

The user interface 70 represents an interface that may allow a user to provide information to the exercise system 10, that may allow the exercise system 10 to provide information to a user, or both. The user interface 70 may be a local user interface that is attached to the exercise system 10. For example, the user interface 70 may be a display screen (e.g., a touchscreen), a reading device (e.g., a scanner, an radio-frequency identification (RFID) reader, an NFC reader), a joystick, an audio device, any other input/output device, or any combination of the preceding. In the illustrated example, the exercise system 10 includes at least a display screen (e.g., touchscreen) and a reading device as local user interfaces 70. The display screen may be used to receive inputs from the user, and to provide information to the user (e.g., explain the workout, explain the exercise, provide a video of a trainer explaining and/or showing how to do the workout and/or exercise). The reading device may be used to read a tag or fob (e.g., RFID) carried by the user, so as to uniquely identify the user.

Alternatively (or additionally), the user interface 70 may be a remote user interface that may be used remotely from the exercise system 10. For example, the user interface 70 may be a remote, a user's Smartphone (executing an application ("app") associated with the exercise system 10), any other remote device, or any combination of the preceding. In the illustrated example, the exercise system 10 includes at least a user's Smartphone as a remote user interface 70. The app on the user's Smartphone may be used to receive inputs from the user, to provide information to the user (e.g., explain the workout, explain the exercise, provide historical performance statistics), and to uniquely identify the user.

The user interface 70 may include a visual display (e.g., on the touchscreen, on the user's Smartphone, etc.) that informs the user about the operational state of the exercise system 10 and/or about a current exercise routine being performed by the user. The visual display may be used to provide a visual indication (e.g., a graphical illustration) of such information. The user interface 70 may also (or alternatively) include a speaker that informs the user about the operational state of the exercise system 10 and/or about a current exercise routine being performed by the user. The speaker may be used to provide an audible indication of such information. Examples of the information provided by the user interface 70 may include an indication (and/or description) of the current exercise in an exercise routine, an indication of the number of repetitions/sets remaining in the exercise routine, an indication of the time remaining in the exercise routine, an indication of the current weight of each weighted touchpoint 22, an indication of when components of the exercise system 10 are currently being moved to a different position, an indication of when the exercise system 10 is ready for the user to perform an exercise (e.g., readiness of the exercise system 10, readiness of a new weight on a weighted touchpoint 22), an indication of any other information, or any combination of the preceding.

The user interface 70 (e.g., local interface or remote interface) may be used prior to a workout routine, during a workout routine, or after a workout routine. As an example of this, a user may utilize an app on their Smartphone to interact with the exercise system 10 or an external storage system 74 (discussed below) to view previous workouts (and workout performance), to view the next workout, to input their status (e.g., injured arm), view and/or provide any other information, or any combination of the preceding. For example, the user can use the Smartphone app to tell the exercise system 10 that the user injured their arm. This may cause the exercise system 10 to adjust the next workout routine (e.g., no upper body exercises) so as to prevent aggravation of the injury.

As is discussed above, the user profile(s) 66 may be stored locally in the exercise system 10 at memory unit 58. In some examples, one or more (or all) of the user profile(s) 66 may alternatively (or additionally) be stored remotely at an external storage system 74. The external storage system 74 may store the user profile(s) 66, and may further communicate with the control system 46 to provide the control system 46 with any requested user profile 66. This may allow the external storage system 74 to provide the control system 46 with the most up to date version of a user profile 66. The control system 46 may communicate with the external storage system 74 to retrieve a particular user profile 66 when that user is attempting to use the exercise system 10.

External storage system 74 represents any suitable components that can store user profile(s) 66, update user profile(s) 66, and transmit the user profile(s) 66 to an external device that requests them (e.g., the control system 46). External storage system 74 may include a network server, any suitable remote server, a mainframe, a host computer, a workstation, a web server, a personal computer, a laptop, a mobile telephone (such as a Smartphone), an electronic notebook, a file server, any other suitable device for storing, updating, and transmitting user profile(s) 66, or any combination of the preceding. The functions of external storage system 74 may be performed by any suitable combination of one or more servers or other components at one or more locations. In an embodiment where the external storage system 74 is a server, the server may be a private server, and the server may be a virtual or physical server. The server may include one or more servers at the same or remote locations. Also, external storage system 74 may include any suitable component that functions as a server. As is illustrated, the external storage system 74 is a database server.

By storing the user profile(s) 66 remotely at the external storage system 74, a user may be able to more easily work out at many different exercise systems 10, in some examples. For example, the external storage system 74 may store the most up-to-date version of a particular user's user profile 66. In such an example, this most up-to-date version of the user profile 66 may be accessible to any exercise system 10 (or other device) that requests it. As such, a user can work out at their home exercise system 10, and then the user can later work out at a different exercise system 10 (e.g., at another person's home, at the office, or at any other workout facility) without losing the ability to access their user profile 66. For example, if a user works out at their home exercise system 10 for a particular muscle group on a first day, and the next day works out at a different exercise system 10 (e.g., at the gym), the gym exercise system 10 will be able to identify the user, retrieve their last workout routine completed at home, and randomize the workout at the gym. The different exercise system 10 may also be able to retrieve the user's adjustments to the exercise system 10 (discussed above) from the user profile 66, and be able to automatically adjust the exercise system 10 (e.g., adjust the user bench 26) for the user based upon prior saved positions included in the user profile 66.

To provide power for operation, the exercise system 10 may be coupled to a power source. For example, the exercise system 10 may be powered by a power source comprising one or more batteries, an a/c outlet, or combination thereof. In the illustrated example, the exercise system 10 may include a socket or plug configured to couple to an a/c outlet to provide power. In other examples, the exercise system 10 may include a rechargeable battery. This rechargeable battery may be removed, re-charged, and replaced (or changed to an entirely new battery), in some examples. The rechargeable battery may also be charged by the exercise system 10 when it is coupled to an a/c outlet via a plug.

In one example, the exercise system 10 may be an exercise machine or device that can automatically adjust the weight lifted by a user after each exercise, after each set in an exercise, and/or after each repetition in an exercise. This automatic adjustment of weights may include an automatic adjustment of offset loaded weights, where the weight may be heavier on one side of the body than on the other side of the body. The automatic adjustment of weights may further include an automatic adjustment of weights that can be utilized simultaneously by two or more limbs of the user (e.g., two arms, two legs, one arm and one leg, two arms and one leg, one arm and two legs, two arms and two legs). The exercise system 10 may further adjust weights for any number of different exercises, such as chest presses, seated rows, leg extensions, leg presses, and hamstring curls. The exercise system 10 may further generate workouts that are customized to a user. The user may be uniquely identified using an identifier, such as a phone number and password, email address and password, an RFID/NFC card, or an RFID/NFC fob. The exercise system 10 may further generate workouts that are randomized. These randomized workouts may be created so as to be different from the previous workout. As an example of this, the exercises in the workout may be randomized by muscle group, weight amount, weight differential, number of sets of the exercise, number of repetitions in the set, any other manner, or any combination of the preceding. Preferably, for each session for a particular muscle group, the user will not be experiencing the same consecutive routine. In some examples, the exercise system 10 may generate workouts that are not randomized. In other examples, the exercise system 10 may allow for user-selected exercises and/or user-selected weights. For example, a user may input their desired weight for an exercise (e.g., their desired weight for one or more weighted touchpoints 22, their desired weight differential for one or more weighted touchpoints 22, etc.), and the exercise system 10 may automatically adjust the weight(s) pursuant to the selection.

FIGS. 2A-2C illustrate another example of the exercise system 10. With reference to FIGS. 2A-2C, in various examples, the exercise system 10 includes the vertical housing 14 that extends vertically outward from the base 18, one or more weighted touchpoints 22 moveably coupled to the vertical housing 14, and the user bench 26 moveably coupled to the vertical housing 14. The vertical housing 14, the base 18, the weighted touchpoints 22, the user bench 26 (and any other components) of FIGS. 2A-2C are substantially similar to the vertical housing 14, the base 18, the weighted touchpoints 22, the user bench 26 (and any other components) of FIGS. 1A-1C, in some examples.

As is discussed above, the exercise system 10 includes the vertical housing 14 and the base 18. The vertical housing 14 and/or the base 18 may have any dimensions. In the example illustrated in FIGS. 2A-2C, the base 18 has a length and width that is smaller than the length and width of the vertical housing 14. However, any other dimensions of the base 18 and/or vertical housing 14 may be included in the exercise system 10.

As discussed above, the weighted touchpoint(s) 22 may be any device or structure that may be used by a user to perform one or more exercise. In the illustrated example, the weighted touchpoint(s) 22 are pulley devices. Each pulley device may include a handle and a cable. The handle may be attached (e.g., via a clip) to a first end of the cable, and the second end of the cable may extend into the vertical housing 14 (as is shown in FIG. 2C), and may be attached to a weight system 42 that provides weight (e.g., via resistance).

As is also discussed above, the weighted touchpoints 22 may be positioned on any portion of the vertical housing. In the illustrated example, the weighted touchpoints 22 are positioned on the sides (i.e., left side and right side) of the vertical housing 14. In particular, in the illustrated example, the weighted touchpoint 22*a* is positioned on the front of the vertical housing 14 in a location that is left of the middle point on the front of the vertical housing 14, and the weighted touchpoint 22*b* is positioned on the front of the vertical housing 14 in a location that is right of the middle point on the front of the vertical housing 14. This positioning allows a weighted touchpoint 22 (e.g., weighted touchpoint 22*a*) to be used to exercise muscle(s) on a first side of the user's body (e.g., the left side), and further allows another weighted touchpoint 22 (e.g., weighted touchpoint 22*b*) to be used to exercise muscle(s) on a second opposite side of the user's body (e.g., the right side).

As is further discussed above, the weighted touchpoints 22 may be moveably attached to the vertical housing 14, and they may be moveably attached in any manner that allows them to move along the vertical axis (e.g., shown as double arrow 24 in FIGS. 1A-1B). In the illustrated example, the weighted touchpoints 22 are each attached to a respective notched rack (or rail) in the exercise system 10 via a respective spring lock. When a user unlocks the spring lock, the user can manually slide each weighted touchpoint 22 up or down along the notched rack. When moved, the spring lock may automatically drop into the next notch in the notched rack. When the weighted touchpoint 22 reaches the correct vertical height, the spring lock may automatically drop into the notch associated with the height, and the user may re-lock the spring lock. The height of each weighted touchpoint 22 may be adjusted individually. Although the weighted touchpoint 22 has been described above as being moved along the vertical axis manually by a user, the weighted touchpoint 22 may be moved automatically (e.g., robotically driven) by the control system 46, in some examples.

As is also discussed above, the exercise system 10 may include any number of weighted touchpoints 22. In the illustrated example, the exercise system 10 includes two weighted touchpoints 22 (i.e., 22*a* and 22*b*). Each of these weighted touchpoints 22 may be individually moved upward and downward along the respective notched rack, which spans a substantial portion of the height of the vertical housing 14. This may allow each weighted touchpoint 22 to operate as both an upper weighted touchpoint 22 and a lower weighted touchpoint 22.

As is further discussed above, the user bench 26 may be positioned on vertical housing 14 and/or the base 18. In the example illustrated in FIGS. 2A-2B, the user bench 26 is positioned on the vertical housing 14 by a moveable attachment to the vertical housing 14. Furthermore, the user bench 26 is foldable in relation to the vertical housing 14 (as is illustrated in FIG. 2B). By being foldable, the user bench 26 may fold upward (in a swinging motion) towards the vertical housing 14 (to be positioned as shown in FIG. 2B), and may further un-fold downward (in a swinging motion) away from the vertical housing 14 (to be positioned as shown in FIG. 2A). The upward folding of the user bench 26 may allow the user bench 26 to be moved off the floor, so as to reduce the footprint of the exercise system 10 when the user bench 26 is not in use. The folding and unfolding of the user bench 26 may be performed manually by a user, automatically (e.g., robotically driven) by the control system 46, or a combination of the preceding. When unfolded (as shown in FIG. 2A), one or more of the weighted touchpoints 22 may be coupled to the leg attachment 30 of the user bench 26, so as to allow a user to perform one or more leg-based exercises with weights.

The exercise system 10 also includes one or more weight systems 42 that may provide weight (e.g., via resistance) for the weighted touchpoints 22. FIG. 2C, which is a front perspective view of the exercise system 10 with the front panel removed, illustrates one example of the weight systems 42 of an exercise system 10. As is illustrated in FIG. 2C, the exercise system 10 includes two weight systems 42 (i.e., 42*a* and 42*b*), with a separate weight system 42 for each weighted touchpoint 22. The weight systems 42 may allow the weight of each weighted touchpoint 22 to be adjusted individually.

As is discussed above, the weight system 42 may be any device and/or structure that may provide weight for the weighted touchpoints 22. In the example illustrated in FIG. 2C, the weight system 42 is a screw and weights system. The screw and weights system may include one or more screws and one or more stacks of preset weight blocks. To add weight, the screw may be rotated in a first direction (e.g., to move downward), causing the screw to thread into one or more preset weight blocks within a stack of the blocks. Once the screw is threaded into a preset weight block, that preset weight block is now attached to the weighted touchpoint 22, thereby causing the weight to be increased. To remove weight, the screw may be rotated in a second direction (e.g., to move upward), causing the screw to unthread from one or more preset weight blocks within the stack of the blocks. Once the screw is unthreaded from a preset weight block, that preset weight block is no longer attached to the weighted touchpoint 22, thereby causing the weight to be decreased. The movement of the screw (e.g., upward, downward) may be performed manually by a user (e.g., via a crank), automatically (e.g., robotically driven) by the control system 46 and a motor, or a combination of the preceding.

In the example illustrated in FIG. 2C, the weight system 42*a* is a screw and weight system that includes two screws (i.e., a lead screw 78*a*, and a micro screw 80*a*), two stacks of preset weight blocks (i.e., a lead stack 82*a* for large adjustments of weight, and a micro stack 84*a* for small adjustments of weight), and two motors (i.e., a lead motor 86*a*, and a micro motor 88*a*) for moving the screws 78*a* and 80*a*. When a large change of weight is desired, the lead motor 86*a* may move the lead screw 78*a* downward (or upward) causing the lead screw 78*a* to thread into (or unthread) from one or more large weights within the lead stack 82*a*. When a small change of weight is desired, the micro motor 88*a* may move the micro screw 80*a* downward (or upward) causing the micro screw 80*a* to thread into (or unthread) from one or more small weights within the micro stack 84*a*. In some examples, the micro stack 84*a* may be used to create the weight differential for offset loading. Also, in the illustrated example, the weight system 42*b* is a separate screw and weight system that includes two screws (i.e., a lead screw 78*b*, and a micro screw 80*b*), two stacks of preset weight blocks (i.e., a lead stack 82*b* for large adjustments of weight, and a micro stack 84*b* for small adjustments of weight), and two motors (i.e., a lead motor 86*b*, and a micro motor 88*b*) for moving the screws 78*b* and 80*b*. Although separate from weight system 42*a*, the function of weight system 42*b* is similar to that discussed above for weight system 42*a*. Furthermore, each weight system 42*a* and 42*b* may be operated independently of each other. This allows for independent adjustment of weights for each weighted touchpoint 22, so as to provide for offset loading on different parts of the body, in some examples.

The exercise system 10 may also include the control system 46. FIG. 1C (discussed above) schematically illustrates an example of the control system 46 and other components of the exercise system 10 of FIGS. 2A-2C.

FIGS. 3A-3F illustrate another example of the exercise system 10 in operation by a user. With reference to FIGS. 3A-3F, in various examples, the exercise system 10 includes the vertical housing 14 that extends vertically outward from the base 18, one or more weighted touchpoints 22 moveably coupled to the vertical housing 14, and the user bench 26 moveably coupled to the vertical housing 14. The vertical housing 14, the base 18, the weighted touchpoints 22, the user bench 26 (and any other components) of FIGS. 3A-3F are substantially similar to the vertical housing 14, the base 18, the weighted touchpoints 22, the user bench 26 (and any other components) of FIGS. 1A-1C and/or 2A-2C, in some examples.

As is discussed above, the exercise system 10 includes the vertical housing 14 and the base 18. The vertical housing 14 and/or the base 18 may have any dimensions. In the example illustrated in FIGS. 3A-3F, the base 18 has a length and width that is smaller than the length and width of the vertical housing 14. However, any other dimensions of the base 18 and/or vertical housing 14 may be included in the exercise system 10.

As discussed above, the weighted touchpoint(s) 22 may be any device or structure that may be used by a user to perform one or more exercises. In the illustrated example, the weighted touchpoint(s) 22 are pulley devices. Each pulley device may include a handle and a cable. The handle may be attached (e.g., via a clip) to a first end of the cable, and the second end of the cable may extend into the vertical housing 14, and may be attached to a weight system 42 that provides weight (e.g., via resistance). In some examples, to provide weight for leg-based exercises, one or more of the weighted touchpoints 22 may be attached to the leg attachment 30 of the user bench 26. As an example of this, the handle may be removed from the pulley device of the lower weighted touchpoint 22*c* and/or 22*d*, and then the cable of the lower weighted touchpoint 22*c* and/or 22*d* may be attached to the leg attachment 30.

As is also discussed above, the weighted touchpoints 22 may be positioned on any portion of the vertical housing. In the illustrated example, the weighted touchpoints 22 are positioned on the sides (i.e., left side and right side) of the vertical housing 14. In particular, in the illustrated example, the weighted touchpoint 22*a* is positioned on the front of the vertical housing 14 in a location that is left of the middle point on the front of the vertical housing 14, the weighted touchpoint 22*b* is positioned on the front of the vertical housing 14 in a location that is right of the middle point on the front of the vertical housing 14, the weighted touchpoint 22*c* is positioned on the front of the vertical housing 14 in a location that is left of the middle point on the front of the vertical housing 14 and right of weighted touchpoint 22*a*, and the weighted touchpoint 22*d* is positioned on the front of the vertical housing 14 in a location that is right of the middle point on the front of the vertical housing 14 and left of the weighted touchpoint 22*b*. This positioning allows a weighted touchpoint 22 (e.g., weighted touchpoint 22*a*) to be used to exercise upper muscle(s) (e.g., arm-based muscles) on a first side of the user's body (e.g., the right side), allows another weighted touchpoint 22 (e.g., weighted touchpoint 22*b*) to be used to exercise upper muscle(s) (e.g., arm-based muscles) on a second opposite side of the user's body (e.g., the left side), allows another weighted touchpoint 22 (e.g., weighted touchpoint 22*c*) to be used to exercise lower muscle(s) (e.g., leg-based muscles) on a first side of the user's body (e.g., the right side), and further allows another weighted touchpoint 22 (e.g., weighted touchpoint 22*d*) to be used to exercise lower muscle(s) (e.g., leg-based muscles) on a second opposite side of the user's body (e.g., the left side).

As is further discussed above, the weighted touchpoints 22 may be moveably attached to the vertical housing 14, and they may be moveably attached in any manner that allows them to move along the vertical axis (e.g., shown as double arrow 24 in FIGS. 1A-1B). In the illustrated example, the weighted touchpoints 22 are each attached to a respective notched rack (or rail) in the exercise system 10 via a respective spring lock. When a user unlocks the spring lock, the user can manually slide each weighted touchpoint 22 up or down along the notched rack. When moved, the spring lock may automatically drop into the next notch in the notched rack. When the weighted touchpoint 22 reaches the correct vertical height, the spring lock may automatically drop into the notch associated with the height, and the user may re-lock the spring lock. The height of each weighted touchpoint 22 may be adjusted individually. Although the weighted touchpoint 22 has been described above as being moved along the vertical axis manually by a user, the weighted touchpoint 22 may be moved automatically (e.g., robotically driven) by the control system 46, in some examples.

As is also discussed above, the exercise system 10 may include any number of weighted touchpoints 22. In the illustrated example, the exercise system 10 includes four weighted touchpoints 22 (i.e., upper weighted touchpoint 22*a*, upper weighted touchpoint 22*b*, lower weighted touchpoint 22*c*, and lower weighted touchpoint 22*d*). Each of the weighted touchpoints 22 may be individually moved upward and downward along the respective notched rack, which spans a portion of the height of the vertical housing 14.

As is further discussed above, the user bench 26 may be positioned on vertical housing 14 and/or the base 18. In the example illustrated in FIGS. 3A-3F, the user bench 26 is positioned on the vertical housing 14 by a moveable attachment to the vertical housing 14. Furthermore, the user bench 26 is foldable in relation to the vertical housing 14, allowing the user bench 26 to fold upward (in a swinging motion) towards the vertical housing 14, and further allowing the user bench 26 to fold downward (in a swinging motion) away from the vertical housing 14. Examples of this are discussed above with regard to FIGS. 2A-2C. The folding and unfolding of the user bench 26 may be performed manually by a user, automatically (e.g., robotically driven) by the control system 46, or a combination of the preceding. When unfolded, one or more of the weighted touchpoints 22 may be coupled to the leg attachment 30 of the user bench 26, so as to allow a user to perform one or more leg-based exercises with weights.

The exercise system 10 also includes one or more weight systems 42 that may provide weight (e.g., via resistance) for the weighted touchpoints 22. In the illustrated example, the exercise system 10 includes four weight systems (i.e., 42*a*, 42*b*, 42*c*, and 42*d*), with a separate weight system 42 for each weighted touchpoint 22. The weight systems 42 may allow the weight of each weighted touchpoint 22 to be adjusted individually. In the example illustrated in FIGS. 3A-3F, the weight systems 42*a*-42*d* are fully (or partially) enclosed within the vertical housing 14, and are not visible in FIGS. 3A-3F.

As is discussed above, the weight system 42 may be any device and/or structure that may provide weight for the weighted touchpoints 22. For example, the weight system 42 may be a preset weight block system (e.g., an actuated pin and weights system, a screw and weights system), an electromagnetic eddy current resistance system, a friction resistance system, an active-compliance motor system, any other device and/or structure that may provide weight for the weighted touchpoints 22, or any combination of the preceding. In the illustrated example, each of the weight systems 42*a*-42*d* is a screw and weight system, examples of which are discussed above with regard to FIGS. 2A-2C. Furthermore, each of the weight systems 42*a*-42*d* may be operated independently of each other. This allows for independent adjustment of weights for each weighted touchpoint 22, so as to provide for offset loading on different parts of the body, in some examples.

The exercise system 10 may also include the control system 46. FIG. 1C (discussed above) schematically illustrates an example of the control system 46 and other components of the exercise system 10 of FIGS. 3A-F.

Figure 3A:
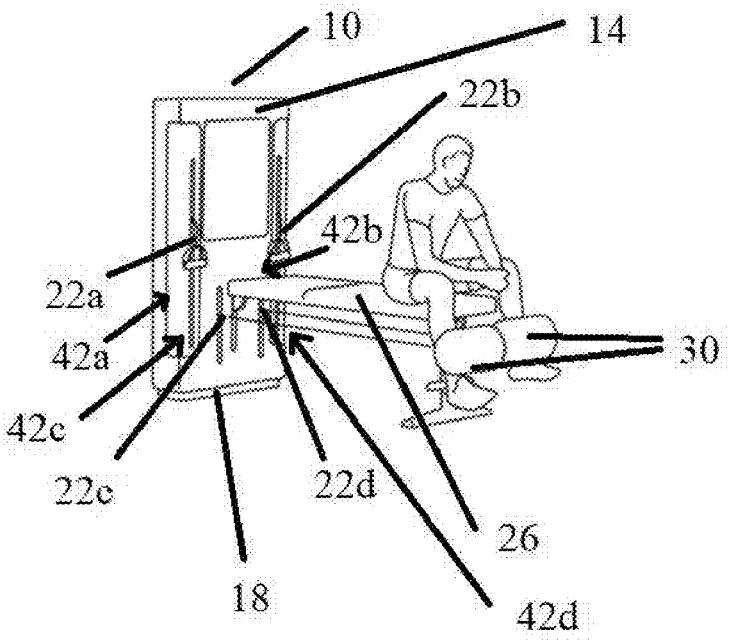
FIGS. 3A-3F are front perspective views of another example of an exercise system in operation by a user.
Figure 3B:
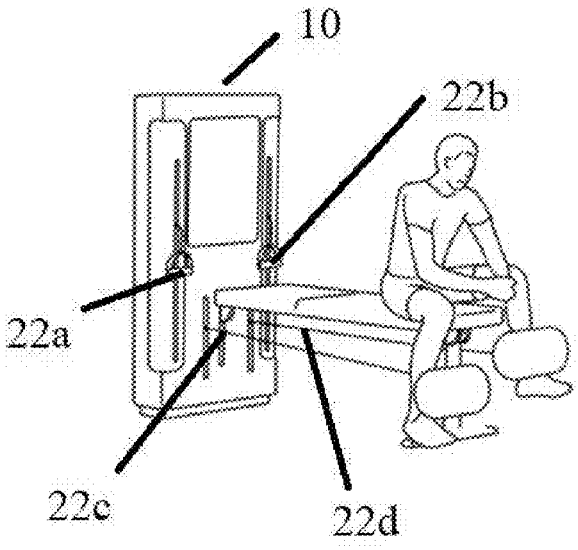
Figure 3C:
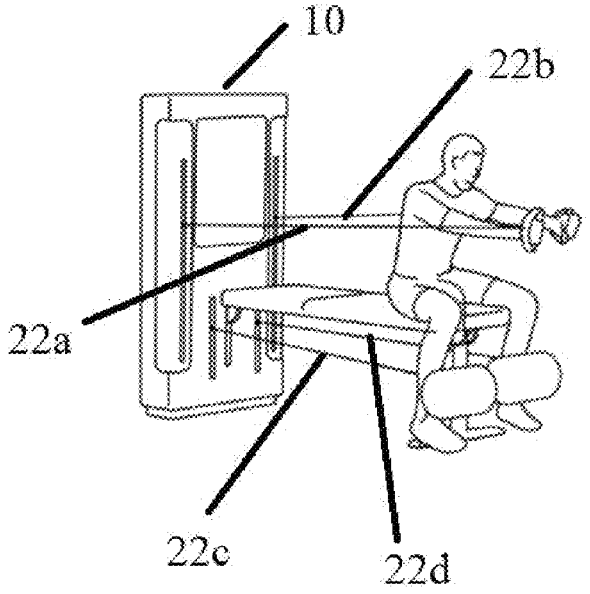
Figure 3D:
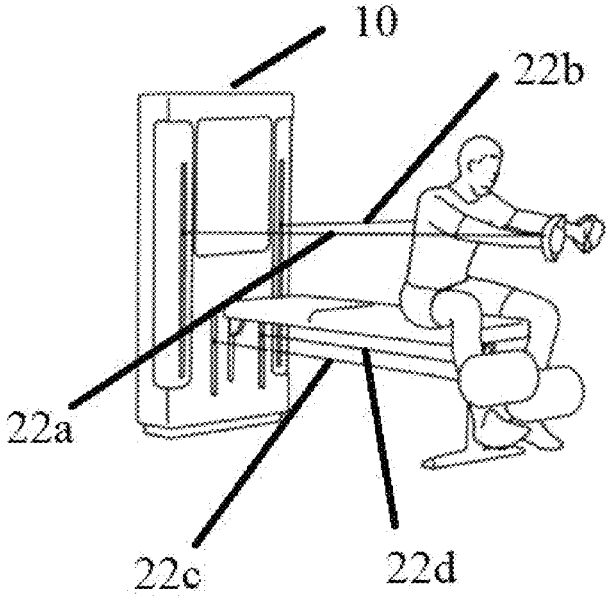
Figure 3E:
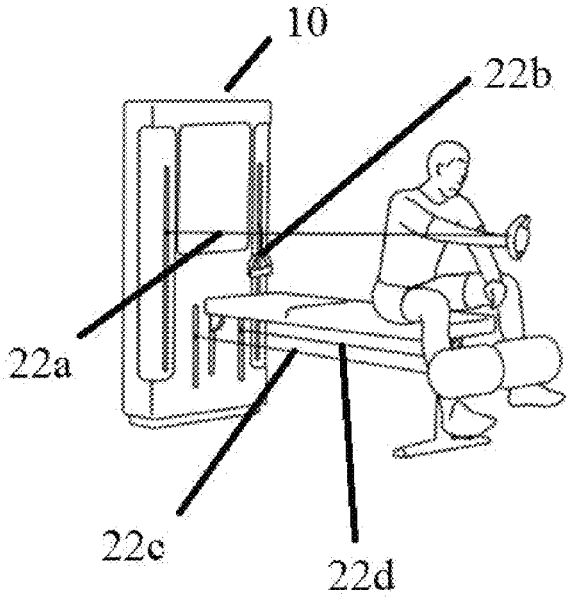
Figure 3F:
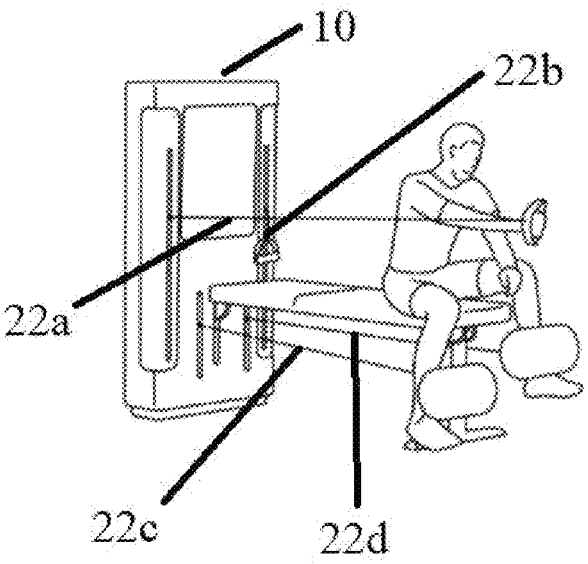

As is discussed above, each of FIGS. 3A-3F illustrate an example of exercise system 10 in operation by a user. FIG. 3A illustrates an example of exercise system 10 in operation by the user to exercise both legs simultaneously. FIG. 3B illustrates an example of exercise system 10 in operation by the user to exercise only a single leg. FIG. 3C illustrates an example of exercise system 10 in operation by the user to exercise both arms simultaneously. FIG. 3D illustrates an example of exercise system 10 in operation by the user to exercise both arms and a single leg simultaneously. FIG. 3E illustrates an example of exercise system 10 in operation by the user to exercise an arm and both legs simultaneously. FIG. 3F illustrates an example of exercise system 10 in operation by the user to exercise a single arm and a single leg simultaneously. In other examples, the exercise system 10 may be used by the user to exercise both arms and both legs simultaneously (not illustrated). In further examples, the exercise system 10 may be used by the user to exercise only a single arm (not illustrated)

As can be seen from above, the exercise system 10 of FIGS. 3A-3F may allow a user to exercise any combination of the user's arm(s) and/or leg(s) alone or simultaneously. The exercise of only a single limb (e.g., arm or leg) refers to exercising only that limb (and its associated muscles) without also simultaneously exercising any other limb. For example, a single left arm may be exercised alone when that left arm (and its associated muscles) is being used to lift a respective weight provided by the exercise system 10 without also simultaneously using the right arm, left leg, and right leg to lift respective weights provided by the exercise system 10.

The simultaneous exercise of two or more limbs refers to those limbs being each exercised during an overlapping period of time. For example, a single arm and a single leg may be exercised simultaneously when both the single arm and single leg are each being used to lift a respective weight provided by the exercise system 10 during an overlapping period of time. This may occur, in some examples, when the single arm and the single leg both start and finish lifting a respective weight provided by the exercise system 10 at the same time. In other examples, this may occur when the single leg starts lifting a respective weight provided by the exercise system 10 before the single arm is finished lifting a respective weight provided by the exercise system 10 (or vice versa). In some examples, the simultaneous exercise of two or more different limbs (e.g., one arm and one leg, two arms and one leg, one arm and two legs, two arms and two legs), with or without different weight amounts (e.g., offset loading), may assist a user with rehabilitation and/or with neuro motor focus. In some examples, such exercises may be used to help treat a user with particular ailments (e.g., stroke, Parkinson's, multiple sclerosis, head trauma).

In order to allow a user to exercise any combination of the user's arm(s) and/or leg(s) alone or simultaneously, the exercise system 10, the weighted touchpoints 22, and/or the weight systems 42 may be configured in any manner that allows for such alone or simultaneous exercise. For example, each of the weighted touchpoints 22 may be positioned on the exercise system 10 in a location that allows all of the weighted touchpoints 22 to be reached by a user (or utilized by user) at the same time. An example of this positioning is illustrated in FIGS. 3A-3F. As another example, each of the weighted touchpoints 22 may be coupled to a separate weight system 42, thereby allowing each of the weighted touchpoints 22 to be utilized simultaneously. As a further example, the exercise system 10 may allow each weighted touchpoint 22 to be operated simultaneously (e.g., the exercise system 10 may allow each pulley of the four weighted touchpoints 22 to be pulled/pushed simultaneously). In a further example, the exercise system 10 may include a locking mechanism that only allows particular weighted touchpoints 22 to be operated simultaneously (e.g., when the user is exercising a first leg and a first arm, the weighted touchpoints 22 for the first leg and the first arm may be unlocked (allowing them to be utilized) while the weighted touchpoints 22 for the second leg and the second arm may be locked (preventing them from being utilized)).

In some examples, the exercise system 10 of FIGS. 3A-3F may allow a user to exercise any combination of the user's arm(s) and/or leg(s) alone or simultaneously, using any combination of weights. For example, the user may utilize the exercise system 10 to exercise each of their arms at the same weight or at different weights, each of their legs at the same weight or at different weights, or each of one or more arms and one or more legs at the same weight or all (or some) at different weights. To allow for this, each of the weighted touchpoints 22 (i.e., 22*a*, 22*b*, 22*c*, and 22*d*) may be coupled to a separate weight system 42 (i.e., 42*a*, 42*b*, 42*c*, and 42*d*, respectively), and each weight system 42 (i.e., 42*a*, 42*b*, 42*c*, and 42*d*) may be operated independently of the others. This allows for independent adjustment of weights for each weighted touchpoint 22, so as to provide for offset loading on different parts of the body, in some examples.

The weight provided to each weighted touchpoint 22 may determined in any manner, as is discussed above. For example, the control system 10 may randomly select the weight provided to each weighted touchpoint 22 (examples of which are discussed herein). As another example, the user may select the weight and provide it to the control system 42 (example of which are also discussed herein).

Modifications, additions, or omissions may be made to the exercise system 10 of FIGS. 1A-1C, 2A-2C, and/or 3A-3F without departing from the scope of the disclosure. For example, the exercise system 10 of FIGS. 1A-1C, 2A-2C, and/or 3A-3F may include any number of weighted touchpoints 22, weight systems 42, control systems 46, communication ports 50, processors 54, memory units 58, user interfaces 70, external storage systems 74, any other devices or components, or any combination of the preceding. Also, any suitable logic may perform the functions of the exercise system 10 of FIGS. 1A-1C, 2A-2C, and/or 3A-3F.

Figure 4:
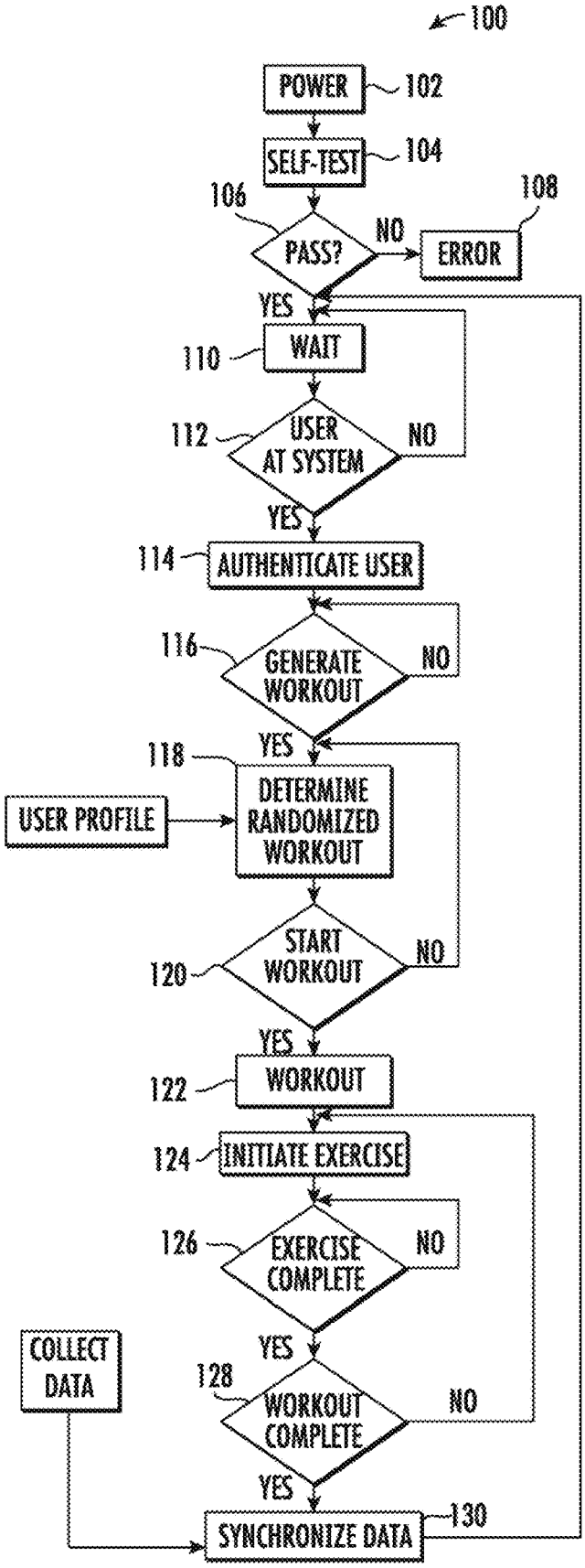
FIG. 4 is a flowchart illustrating one example of the operation of the exercise system of FIG. 1A, FIG. 2A, and/or FIG. 3A.

FIG. 4 is a flowchart depicting an example operation 100 of the exercise system 10, such as the exercise system 10 of FIGS. 1A-1C, 2A-2C, and/or 3A-3F. The method starts at step 102, where the exercise system 10 is powered on. The exercise system 10 may be powered on in any manner, such as by plugging the exercise system 10 into an a/c outlet, and/or by switching on the power button (e.g., at or near the user interface 70).

Once powered on, the control system 46 may initialize (at step 104) a self-calibration test and/or self-test to determine at step 106 if the exercise system 10 is ready to be used. If the exercise system 10 does not pass the test(s), the method may move to step 108 where the exercise system 10 may enter an ERROR state. The exercise system 10 may be locked in this ERROR state until power cycling is performed to clear the ERROR. Such power cycling may include resetting the exercise system 10, which may clear the ERROR. If resetting the exercise system 10 does not work, the exercise system 10 may need maintenance.

On the other hand, if the exercise system 10 passes the test(s), the method may move to step 110 where the exercise system 10 may enter a WAIT state. This WAIT state may cause the control system 46 to determine whether a user is at the exercise system 10. The control system 46 may determine whether a user is at the exercise system 10 in any manner. For example, the control system 46 may determine that a user is at the exercise system 10 when the user interacts with a user interface 70 (either locally or remotely), when the user touches a weighted touchpoint 22, when the presence of the user is sensed via one or more sensors (e.g., vibration sensors, noise sensors, etc.), when the control system 46 is in communication range of a Smartphone or other device carried by a user, any other manner of determining that that a user is at the exercise system 10, or any combination of the preceding.

If the control system 46 determines (at step 112) that a user is not at the exercise system 10, the exercise system 10 may remain in the WAIT state (at step 110). The exercise system 10 may remain in the WAIT state until the control system 46 determines (at step 112) that a user is at the exercise system 10, or until the exercise system 10 is powered off. If the exercise system 10 remains in the WAIT state for an extended period of time (e.g., 30 seconds, 1 minute, 5 minutes, or any other predetermined amount of time), the control system 46 may put the exercise system 10 in a STANDBY mode so as to reduce power usage. This STANDBY mode may not prevent the control system 10 from continuing to determine (at step 112) whether a user is at the exercise system 10.

If the control system 46 determines that a user is at the exercise system 10, the method may move to step 114 where the control system 46 authenticates the user. The control system 46 may authenticate the user in any manner. As one example of this, the user may input their credentials at the user interface 70, and the control system 46 (or the external storage system 74) may match these credentials to a particular user profile 66. The credentials may be any information that identifies the user, such as a user identifier (e.g., username, e-mail address, phone number) and a password, a thumbprint, a handprint, a code, etc.

As another example, the user may utilize a physical identifying device (e.g., an identification card, a key fob with an RFID or NFC chip) to perform the authentication. For example, a user interface 70 may be a reading device (e.g., a scanner, an RFID reader, an NFC reader), and the user may allow the reading device to read (or otherwise communicate with) the physical identifying device. This reading (or communication) may provide a unique identifier of the user to the control system 46, allowing the control system 46 (or the external storage system 74) to match the unique identifier to a user profile 66.

As a further example, the user may utilize their Smartphone (or any other wireless device) to perform the authentication. For example, the user may download an application ("app") associated with the exercise system 10, and then the user may login to the app. This login will cause the app to have a unique identifier associated with the user. When the user's Smartphone is near the exercise system 10, the Smartphone (and its app) may pair with the exercise system 10 through BLUETOOTH or other close-ranged profile (e.g., NFC). This pairing will cause the app to transmit the unique identifier to the control system 46. The control system 46 (or the external storage system 74) may then match the unique identifier to a user profile 66.

If the user is not in the system, the control system 46 will ask the user (at step 114) to create a new account for the exercise system 10. The control system 46 may utilize the user interface 70 (e.g., a touchscreen or an app on the user's Smartphone) to ask the user to create the new account. This new account will generate a user profile 66 for the user.

To create the new account, the user may input (via a user interface 70 such as a touchscreen or the app on the user's Smartphone) personal data, such gender, age, height, weight, any past or present medical conditions, any past or present exercise experience (e.g., no experience, moderate experience, advanced experience, etc.), any exercise goals (e.g., weight loss amount, maximum weight lift amount), blood pressure, heart rate, any other personal data, or any combination of the preceding. The user may also input the credentials and/or unique identifier that the user wants to associate with the account. These credentials and unique identifiers may be used to authenticate the user (as is discussed above).

To create the account, the control system 46 may also conduct a strength test on the user. This strength test may utilize one or more of the weighted touchpoints 22, and may test upper body strength (e.g., both arms), lower body strength (e.g., both legs), body symmetry (e.g., each arm and leg may be tested individually to determine which leg is stronger and which arm is stronger), any other strength test, any endurance test, or any combination of the preceding. In some examples, the strength test may be used by the control system 46 to determine the maximum amount of weight that the user can possibly lift for one repetition (i.e., 1 RM). This may allow the user's strength and/or endurance to be measured (or otherwise determined) in order to establish a payload baseline before initiating rigorous workouts.

In some examples, this strength test may not be limited to the creation of a new account. For example, the user may be asked to perform a strength test once a month (or at any other time interval). This will allow the control system 46 to determine the user's progress, which may allow the control system 46 to update the user's payload baseline. This may allow the control system 46 to make adjustments to a user's subsequent workouts.

To finish the new account, the control system 46 may then ask the user to select a workout protocol. For example, the user may select whether they wish to exercise 1 day, 2 days, 3 days, 4 days, 5 days, or more days per week. Then the control system 46 may utilize this collected information to determine a workout regimen for the user. The workout regimen may refer to a workout protocol that instructs the user how to exercise. For example, the workout protocol may indicate what muscle groups should be exercised by the user, what exercises should be used to exercise, what starting weight should be used by the user (per weighted touchpoint 22), a maximum and minimum number of sets and reps for each exercise, an offset load amount, any other information for a workout protocol, or any combination of the preceding. The control system 46 may determine the workout regimen for the user in any manner. For example, the control system 46 may create the workout regimen. As an example of this, the control system 46 may utilize artificial intelligence to analyze the data about the user and create the workout regimen. As another example, another person or system may create the workout regimen (using the information collected by the control system 46), and this workout regimen may be transmitted to the control system 46. For example, a professional trainer may create the workout regimen and provide it to the control system 46. As another example, the user may create the workout regimen and provide it to the control system 46.

Once the new account is finished, it may be saved by the control system 46 as a new user profile 66. The user profile 66 may also be transmitted to external storage system 74 for remote storage. In some examples, the control system 46 may store a predetermined number of user profiles 66 (e.g., 25 user profiles 66) in the local memory (i.e., memory unit 58) for a predetermined amount of time (e.g., 1 month). This may allow the control system 46 to access these user profiles 66 even if the exercise system 10 is temporarily unable to communicate with the external storage system 74 (e.g., due to a temporary absence of internet connectivity).

Following the authentication of the user (or creation of a new account), the method may move to step 116, where the control system 46 determines whether the user wants to generate a workout to perform. The control system 46 may determine this in any manner. For example, the control system 46 may determine that the user wants to generate a workout when the user selects a "GENERATE WORKOUT" button on the user interface 70. If the control system 46 determines that the user does not yet want to generate a workout, the method may enter a WAIT state. The control system 46 may exit this WAIT state when it determines that the user wants to generate a workout.

If the control system 46 determines that the user wants to generate a workout, the method may move to step 118, where the control system 46 determines a randomized workout for the user. A randomized workout refers to a workout routine that is randomized so as to create a workout that is different from the previous workout. This prevents a user from exercising in the same way in consecutive workouts. The idea is to keep a user's body and mind guessing and to always keep the user in a state of surprise and/or unbalanced. This may maximize cognitive effort and minimize muscle memory, in some examples. Preferably, any particular workout routine will not be replicated in any consecutive manner.

In some examples, the randomized workout may not be fully random. A fully random workout could possibly result in two identical consecutive workouts (although unlikely). Instead, the randomized workout may be partially random. In this partially random workout, the control system 46 can adjust the random outcome so as to prevent consecutive workouts from being identical. For example, if a user previously conducted an upper body workout, and the control system 46 selected (randomly) an upper body workout again, this random selection may be discarded and re-randomized until the selection is no longer an upper body workout.

In some examples, the randomized workout may be a weighted randomization. In such examples, particular aspects of the workout may have higher chance of selection. As an example of this, if the user is more interested in cardio workouts, the control system 46 may increase the chance of a cardio workout being randomly selected. For example, the control system 46 may randomly select from a set of workouts that includes twice as many cardio workouts as any other type of workout, thereby increasing the chance of selecting a cardio workout.

In some examples, the randomized workout may be limited randomization. In such examples, an upper and/or lower limit (and/or other limit) may be placed on the randomization, and randomization can only occur within the upper and/or lower limit (i.e., it must occur within the range between the upper and lower limit). As an example of this, a user may have a lower limit of bicep curls at 10 pounds of weight, and an upper limit of bicep curls at 25 pounds of weight. In such an example, the randomization can only randomly select a weight in-between the range of 10 pounds and 25 pounds. Any lower weight or higher weight may be discarded and re-randomized.

Any portion of the workout may be randomized. For example, the entire workout may be randomized. As another example, only a portion of the workout may be randomized. As an example of this, the selection of an upper body workout may not be randomized (i.e., it may be predetermined), but any other portion of the upper body workout may be randomized, such as the type of exercises, the number of sets in an exercise, the number of repetitions in the set, the weights for each repetition, any other factor of the workout, or any combination of the preceding.

A non-exhaustive list of examples of the types of workout aspects that may be randomized are included below. All or a portion of these types (or any other type) may be randomized in each workout.

As a first example, the randomized workout may include a selection (random or non-random) of a muscle group. A muscle group may refer to one or more groups of muscles that may be exercised or one or more portions of a body that may be exercised, such as the upper body, lower body, core, full body, legs, arms, back, cardiovascular system (e.g., cardio exercises) any other group(s) of muscles, any other portion(s) of a body, or any combination of the preceding (e.g., a combination of lower body and upper body simultaneously). In some examples, the selection may be a random or non-random selection from a closed list of muscle groups. That is, there may be a closed list of, for example, 8 muscle groups, and the selection may include a random or non-random selection of one (or more) of these 8 groups. In some examples, the selection may prevent the same muscle group from being selected for two consecutive workouts. In other examples, the same muscle group may be selected for two consecutive workouts.

The selection of a muscle group may be randomized in a manner that still allows all (or most) of the muscle groups to be exercised during a particular time period (such as a week). This may prevent the user from not being able to exercise their full body. As an example of this, if the user is only set up to work out 3 times per week, the selection of the muscle groups may be randomized in a manner that causes the user to work out their upper body on one of those days, their lower body on another one of those days, and their core on the other day. For example, if upper body is randomly selected for the first day, the random selection may only allow for lower body or core to be selected for the second day, and may further only allow for the last muscle group to be selected for the third day. As such, the third day may not be random at all. This, however, can all change the next week. For example, in the next week, core may be randomly selected for the first day, followed by a random selection between upper body and lower body for the second day, and a selection of the last muscle group for the third day. In some examples, this order may be randomized so as to prevent the same order from occurring in consecutive weeks of exercise. That is, from week to week the order of muscle groups may be changed up. As such, if the schedule is to work out upper body on Monday, lower body on Wednesday, and cardio on Friday, the next week the routine may be randomly changed to lower body on Monday, cardio on Wednesday, and lower body on Friday (or any other different order).

As a second example, the randomized workout may include a selection (random or non-random) of exercises within a muscle group. Exercises within a muscle group may refer to one or more exercises that work muscles within a particular muscle group. For example, the upper body muscle group may include one or more exercises that work upper body muscles (e.g., bicep curls, shoulder press, tricep extensions, lat pulldown, seated row, etc.), while the lower body muscle group may include one or more exercises that work lower body muscles (e.g., squat, lunge, glute bridge, leg extension, leg curl, etc.). In some examples, the exercises of two different muscle groups may be combined (e.g., a leg extension for a lower body muscle group may be combined with an arm extension for an upper body muscle group) for simultaneously working out both muscle groups. The selection of exercises within a muscle group may include a selection (random or non-random) of the type of exercises, the number of exercises selected (e.g., 2 exercises, 5 exercises, etc.), the order in which the exercises are to be performed (e.g., start with leg curls, start with leg extensions, etc.), any other selection regarding exercises, or any combination of the preceding. In some examples, the selection may be a random or non-random selection from a closed list of exercises for that muscle group. That is, there may be a closed list of, for example, 25 exercises, and the selection may include a random or non-random selection of one (or more) of these 25 exercises. In some examples, the selection may prevent the same exercises, the same order of exercises, and/or the same number of exercises from being selected for two consecutive workouts of the same muscle group. That is, the workout for lower body may be slightly (or completely) different than that of the most recent previous lower body workout. In other examples, the same exercises, the same order of exercises, and the same number of exercises may be selected for two consecutive workouts of the same muscle group.

As a third example, the randomized workout may include a selection (random or non-random) of exercise duration for each exercise. Exercise duration may refer to any manner of quantifying the amount the user is to perform the exercise, such as the number of sets of the exercise, the number of repetitions of the exercise within a set, the amount of time the user is to perform the exercise (e.g., perform as many bicep curls as possible in 30 seconds, 45 seconds, etc., or hold the squat for 30 seconds, 45 seconds, etc.). In some examples, the selection may be a random or non-random selection of an amount in-between two limits. That is, the amount may have a lower limit and an upper limit, and the control system 46 may make a random or non-random selection of an amount within the range defined by those limits. These limits may be included in the user profile 66 for that particular exercise and/or muscle group for the user. Furthermore, these limits may be continuously updated based on the user's performance during a past workout or a past strength test. In some examples, the selection may prevent the same exercise amount from being selected for two consecutive workouts of the exercise. That is, the bicep curl exercise may be slightly (or completely) different than that of the most recent previous bicep curl exercise. This difference can be in the total amount of repetitions performed, the number of repetitions performed in each set, the number of sets performed, any other difference, or any combination of the preceding. In other examples, the same exercise amount may be selected for two consecutive workouts of the exercise.

As a fourth example, the randomized workout may include a selection (random or non-random) of weight type for each exercise. Weight type may refer to how weight is distributed during an exercise. Examples of weight type may include same weight loading, unilateral, offset loading, or any other manner in which weight may be distributed. Same weight loading may refer to a weight training method where weight on one side is the same as on the other side. As an example of this, same weight loading in bicep curls may utilize a first weight (e.g., 30 pounds) on the left arm, and an identical second weight (e.g., 30 pounds) on the right arm. Unilateral may refer to a weight training method where weight is only used to work muscles on one side of the body. Examples of a unilateral exercise include a forward lunge, a bicep curl on only the left arm (or right arm), and a leg curl on only the left leg (or right leg).

Offset loading may refer to a weight training method where weight on one side is heavier than on the other side. As an example of this, offset loading in bicep curls may utilize a first heavier weight (e.g., 30 pounds) on the left arm, and a second lighter weight (e.g., 20 pounds) on the right arm. Offset loading is known to provide numerous benefits, both from a physiological and neurological vantage point. These advantages may include the ability to expose and fix asymmetries and imbalances in the body, by allowing the weaker side to catch up with the stronger side. That is, it may focus on weaknesses in the body and it may rectify the problem by evening out the imbalances. It may be particularly effective for neural drive (how the brain talks to the muscle), motor control, muscle activation patterns, intramuscular tension, motor unit synchronization and neuromuscular performance. The advantages may further include injury preventative benefits in that a balanced body is a stronger body. Other advantages is that it is effective for core strength and spinal stabilization, improves mechanics of weight lifting by eliminating momentum and jerky motions, and helps promote good form and range of motion. Recent studies have also shown that offset loading is more effective at increasing muscle hypertrophy and symmetry between dominant and non-dominant muscles and drives cognitive effort to a greater degree than traditional same weight training. These changes are a strong prerequisite to modify muscular imbalances and increase the ability of the muscular system to adapt to high force requiring activities and to repair suboptimal loading patterns. In some examples, the exercise system 10 may introduce a whole new concept of offset loading that now connects better the body to the brain through increased levels of cognitive effort. Studies have shown that a driver of neuro-muscular performance and enhancement is high levels of randomization, such as the randomization provided by the exercise system 10.

In some examples, the selection of weight type for each exercise may be a random or non-random selection from a closed list of weight types. That is, there may be a closed list of, for example, 3 weight types, and the selection may include a random or non-random selection of one (or more) of these 3 types. In some examples, the selection may prevent the same weight type from being selected for that exercise in two consecutive workouts. In other examples, the same weight type may be selected for that exercise in two consecutive workouts.

In some examples, the random selection of weight type for each exercise may preferably be a weighted randomization. For example, it may be desirable for the weight type to be predominantly offset loading. In such an example, the randomization may be set up so that offset loading has a higher chance of selection. This may result in offset loading (or any other weight type) being randomly selected a particular percentage of the time. For example, offset loading may be randomly selected at a rate of approximately 60% (i.e., 60%+/−10%) or any other percentage. In such an example, same weight loading may be randomly selected at a rate of approximately 20% (i.e., 20%+/−10%) or any other percentage, while unilateral may be randomly selected at a rate of approximately 20% (i.e., 20%+/−10%) or any other percentage.

As a fifth example, the randomized workout may include a selection (random or non-random) of weight amount for each exercise. Weight amount may refer to a quantity of weight that is to be used during an exercise, such as 5 pounds, 10 pounds, 15 pounds, etc. In some examples, the selection may be a random or non-random selection of an amount in-between two limits. That is, the amount may have a lower limit and an upper limit, and the control system 46 may make a random or non-random selection of an amount within a range defined by those limits. These limits may be included in the user profile 66 for that particular user. Furthermore, these limits may be continuously updated based on the user's performance during a past workout or a past strength test.

In some examples, the selection of a weight amount may depend on the total number of repetitions selected for that exercise, the number of repetitions selected for each set of that exercise, the number of sets selected for that exercise, any other factor, or any combination of the preceding (or vice versa). For example, the user profile 66 may include a first upper and lower weight limit when the total number of repetitions is less than 24, a second upper and lower weight limit when the total number of repetitions is 24-36, and a third upper and lower weight limit when the total number of repetitions is greater than 36. As such, the control system 46 may use the appropriate upper and lower weight limit when selecting the weight amount.

In some examples, the selection of a weight amount may depend on the weight type selected for that exercise (or vice versa). For example, if offset loading is selected, the weight amount may include a selection of weight differential. Weight differential may refer to the difference in weight on one side of the body in comparison to weight on the other side of the body. For example, if a user is performing bicep curls with a 30 pound weight on their left arm and a 20 pound weight on their right arm, the weight differential is 10 pounds. As a result of this, if offset loading is selected, the weight amount may include a selection of a weight differential, and then that weight differential may be used to select a first weight for the first side of the body and a second weight for the second side of the body.

In some examples, the selection of a weight differential may be a random or non-random selection of an amount in-between two limits. That is, the amount may have a lower limit and an upper limit, and the control system 46 may make a random or non-random selection of an amount within a range defined by those limits. These limits may be included in the user profile 66 for that particular user. Furthermore, these limits may be continuously updated based on the user's performance during a past workout or a past strength test.

In some examples, the selection of a weight amount and weight differential may depend on the total number of repetitions selected for that exercise, the number of repetitions selected for each set of that exercise, the number of sets selected for that exercise, any other factor, or any combination of the preceding (or vice versa). For example, any particular exercise (or entire workout routine) may have the same total of repetitions with the heavier weight on the right side as it does with the heavier weight on the left side.

The selection of weight amount and/or weight differential may prevent the same weight amount and/or weight differential from being selected for two consecutive workouts of that exercise. That is, the weight amount and/or weight different used for a bicep curl exercise may be slightly (or completely) different than that of the most recent previous bicep curl exercise (from the most recent previous workout). As an example of this, for offset loading, the selection may increase/decrease the weights on each side while keeping the weight differential the same, the selection may increase/decrease the weight differential between the left and right sides, or any other manner of creating a different weight amount and/or weight differential. In other examples, the same weight amount and/or weight differential may be selected for two consecutive workouts of that exercise.

As is discussed above, at step 118, the control system 46 determines a randomized workout for the user. The control system 46 may determine the randomized workout in any manner. For example, the control system 46 may determine the randomized workout by generating the randomized workout in real time. That is, the randomized workout may be generated in response the user selecting a "GENERATE WORKOUT" button on the user interface 70 (at step 116). The workout may then generate the workout in a randomized manner, as is discussed above. Furthermore, to generate the workout, the control system 46 may access the user profile 66 stored at the exercise system 10 or stored in the external storage system 74.

As another example, the control system 46 may have previously generated one or more randomized workouts and saved them to the user profile 66. In such an example, the control system 46 may determine the randomized workout by retrieving it from storage in the user profile 66 (as opposed to generating it in real time). These previously generated randomized workouts may be viewable by the user prior to working out. For example, the user may be able to view the next workout after the user finishes their current workout, or the user may be able to view the following week's workouts after the user finishes the last workout of the current week. This may allow the user to know what workouts are coming in the future. The user may view the workouts on the local user interface 70 or the remote user interface 70 (e.g., an app on the user's Smartphone).

Following the determination of the randomized workout, the method may move to step 120, where the control system 46 determines whether the user wants to start the workout. The control system 46 may determine this in any manner. For example, the control system 46 may determine that the user wants to start the work workout when the user selects a "START WORKOUT" button on the user interface 70. If the control system 46 determines that the user does not yet want to start the workout, the method may enter a WAIT state.

In some examples, the WAIT state may provide options to the user to modify the workout. For example, the WAIT state may include an "INJURY" button that allows the user to modify the workout if the selected muscle group includes exercises on a limb or part of the body that is injured. If the "INJURY" button is selected, the user may be provided with a set of selections that allow the user to select the type and/or area of injury. The control system 46 may then determine a new randomized workout that utilizes uninjured muscle groups (e.g., the new randomized workout utilizes a muscle group that was not selected by the user and/or that will not aggravate the muscle group selected by the user), in some examples. The new randomized workout may then be presented to the user.

As another example, the WAIT state may include a "DECREASE DIFFICULTY" button that allows the user to modify the workout if the selected exercise routine is too difficult. If the "DECREASE DIFFICULTY" button is selected, the control system 46 may randomly select a lower weight amount (and/or weight differential) for the exercises, a lower total number of repetitions for the exercises, a lower number of repetitions per set of the exercises, a lower number of sets of the exercises, lower the difficulty of the workout in any other manner, or any combination of the preceding. The new randomized workout may then be presented to the user.

If the control system 46 determines that the user wants to start the workout, the method may move to step 122, where the workout is started. Following the start of the workout, the method may move to step 124 where an exercise is initiated. To initiate an exercise, the exercise system 10 may be adjusted for the exercise, in some examples. Any type of adjustment may be made to the exercise system 10. For example, the vertical position of one or more of the weighted touchpoints 22 may be adjusted for a particular exercise and/or for the particular user, the weight applied by the weight system 42 to one or more weighted touchpoints 22 may be adjusted so as to change the weight in accordance with the randomized workout, the user bench 26 may be adjusted for a particular exercise and/or for the particular user, any other adjustment may be made, or any combination of the preceding.

In some examples, all (or a portion) of the adjustments may be performed automatically (e.g., robotically driven) by the control system 46. For example, when the control application 62 is executed by the processor 54 of the control system 46, the processor 54 may activate the weight system(s) 42 to change the weight applied to one or more weighted touchpoints 22. As another example, the processor 54 may activate one or more exercise system actuators 44 to perform the adjustments of the exercise system 10, such as moving the vertical position of the weighted touchpoint(s) 22, and/or adjusting the user bench 26 (or components of the user bench 26). The exercise system 10 may include one or more safety mechanisms that prevents adjustments from occurring when the user is touching the exercise system 10, in some examples. When the adjustments are complete for an exercise, the control system 46 may inform the user that the exercise system 10 is ready to be used for that exercise. This indication may be made via the user interface(s) 70 (e.g., an audible indication, a visual indication, any other indication, or any combination of the preceding). In other examples, all (or a portion) of the adjustments may be performed manually by a user. For example, the user may physically adjust the exercise system 10.

The exercise may then be performed by the user. While the exercise is being performed, the control system 46 may measure and collect performance statistics for the exercise. For example, the control system 46 may measure the amount of time the exercise takes (e.g., by repetition, by set, by full exercise), workout intensity, force or energy exerted on the weighted touchpoints 22, whether each repetition is fully completed, any other performance statistics, or any combination of the preceding. The exercise system 10 may include any type of sensors for measuring the performance statistics, such as force sensors, load sensors, torque sensors, load cells, strain gauges, pressure sensors, a weight actuation and force sensor board, any other sensor or device, or any combination of the preceding.

At step 126, the control system 46 may determine whether the exercise is complete. The exercise is complete when all repetitions of the exercise have been performed, in some examples. In other examples, the exercise is complete when the user can no longer perform the exercise (due to injury or fatigue), or a timer for the exercise has elapsed. The control system 46 may determine that the exercise is complete in any manner. For example, the control system 46 may automatically determine that the exercise is complete. In such an example, the control system 46 may count the number of repetitions performed by the user (and compare the count to the total repetitions in the exercise), may determine that the timer has elapsed, may determine that the user is no longer applying pressure to the weighted touchpoints 22 for an extended period of time, any other manner, or any combination of the preceding. As another example, the user may tell the control system 46 that the exercise is complete. For example, when the exercise is complete, the user may push an "EXERCISE COMPLETE" button on the user interface 70, the user may audibly tell the control system 46 that the exercise is complete, any other manner, or any combination of the preceding.

If the control system 46 determines that the exercise is not complete, the control system 46 may continue to allow the user to perform the exercise. On the other hand, if the control system 46 determines that the exercise is complete, the method may move to step 128, where the control system 46 may determine whether the entire workout is complete. The workout is complete when all of the exercises have been performed, in some examples. In other examples, the workout is complete when the user can no longer perform the workout (due to injury or fatigue), or a timer for the workout has elapsed. The control system 46 may determine that the workout is complete in any manner. For example, the control system 46 may automatically determine that the workout is complete, such as when the control system 46 determines that the last exercise in the workout has been completed. As another, the user may tell the control system 46 that the workout is complete. For example, when the workout is complete, the user may push a "WORKOUT COMPLETE" button on the user interface 70, the user may audibly tell the control system 46 that the workout is complete, any other manner, or any combination of the preceding.

If the control system 46 determines that the workout is not complete, the control system 46 may move back to step 124 where the next exercise in the workout is initiated. This may repeat until the entire workout is complete. As such, the control system 46 may continue to adjust the exercise system 10 for each exercise of the workout.

If the control system 46 determines that the workout is complete, the method may move to step 130 where the control system 46 may synchronize the data it has collected from the workout. This synchronization may include updating the user profile 66 to include the data collected from the workout. As such, the user profile 66 may include historical information from each previous workout (whether the workout was fully completed or not). This historical information may be a used as a baseline for subsequent workout routines, and may be used to adjust subsequent workout routines. This historical information may be used to adjust one or more limits set for the user in the user profile 66. For example, if the historical information indicates that the workouts are not challenging enough, the control system 46 may increase the upper and lower limits on the weight amount for one or more exercises. These adjustments may be made to any upper/lower limits, or to any other information that is used to generate subsequent workouts. The historical information may also be used to assist in the randomization of a workout. For example, the historical information may identify what muscle group was worked out, what exercises were performed, what weight amounts were used, what repetitions and sets were performed, etc. As such, the next time that same muscle group is selected, the workout routine may be different from the last. For example, the exercises may be different, the weight may be heavier, the weight differential between right and left may change, the number of sets or repetitions within each set may change, any other aspect of the workout routine may be changed, or any combination of the preceding. In the end, the workout routine for the same muscle group may preferably never be exactly the same as the last.

The control system 46 may synchronize the collected data with the user profile 66 stored in local memory, or the control system 46 may communicate with the external storage system 74 to update the user profile 66 stored remotely (or both). Once the collected data is synchronized, it may be available for viewing by the user. For example, the user may view all or a portion of the collected data, such as a summary of the workout and the user's performance at the user interface 70 (either locally or remote). As an example of this, the user may utilize an app on their Smartphone to view a summary of the workout and the user's performance (e.g., post-workout performance statistics). The collected data may be viewable as graphical, textual, and/or numerical performance information.

In some examples, another device (other than the control system 46) may synchronize the collected data. For example, an app on the user's Smartphone may collect the collected information from the control system 46 (via BLUETOOTH, for example), and then the app may synchronize the collected data with the external storage system 74 (via Wi-Fi, for example). This may allow the collected data to be synchronized even if the exercise system 10 is temporarily incapable of communicating directly with the external storage system 74.

Following the synchronization, the method may move back to step 110 where the exercise system 10 may enter a WAIT state and where the control system 46 may determine whether a user is at the exercise system 10. That is, the exercise system 10 and control system 46 may wait for the next user, so as to randomize a workout for the next user.

Modifications, additions, or omissions may be made to method 100 of FIG. 4. For example, although the steps of method 100 are described with regard to exercise system 10, in some examples, one or more of the steps of method 100 may be performed without an exercise system 10. For example, the control system 46 may be incorporated into an app in a user's Smartphone. This may allow the app to generate randomized workouts for a user even without an exercise system 10. For example, the app can generate a randomized workout that can be performed at standard exercise machines (e.g., spin bike, stair stepper, elliptical, etc.), with standard exercise equipment (e.g., dumbbell weights, plyometric blocks, free weights), by the user alone (e.g., bodyweight exercises, runs, etc.), or any combination of the preceding. As another example, although the steps of method 100 are described above as generating a randomized workout, in some examples, a non-randomized workout may be generated. Such a non-randomized workout may allow for the same workout routine to be performed consecutively, in some examples. Furthermore, the same workout routine may be performed consecutively in any number of times.

Additionally, the steps of method 100 may be performed in parallel or in any suitable order, or one or more of the steps of method 100 may be omitted. For example, the exercise system 10 may allow a user to skip one or more of the steps of method 100. As one example of this, the user may select the workout they want to perform (e.g., via a local interface or a remote interface, such as a Smartphone), which may cause the method to skip at least step 118 (where a randomized workout is determined). The user may provide any selection for the workout. For example, the user may select a muscle group, exercises within a muscle group, exercise duration for each exercise, weight type for each exercise (e.g., offset loading), weight amount, weight differential, any or other exercise-based selection, or any combination of the preceding. As one example of this, the user may provide a selection of two or more limbs to exercise simultaneously, and may further provide a selection of weights (e.g., different weights) for each limb. In some examples, the user selection may be provided via a "QUICK START" selection made by the user (e.g., via a local interface or a remote interface).

This specification has been written with reference to various non-limiting and non-exhaustive examples. However, it will be recognized by persons having ordinary skill in the art that various substitutions, modifications, or combinations of any of the disclosed examples (or portions thereof) may be made within the scope of this specification. Thus, it is contemplated and understood that this specification supports additional examples not expressly set forth in this specification. Such examples may be obtained, for example, by combining, modifying, or reorganizing any of the disclosed steps, components, elements, features, aspects, characteristics, limitations, and the like, of the various non-limiting and non-exhaustive examples described in this specification.

What is claimed is:

1. An exercise system, comprising:

a base;

a vertical housing extending vertically outward from the base;

a first upper weighted touchpoint coupled to the vertical housing and configured to allow a user to exercise a first arm of the user;

a first weight system coupled to the first upper weighted touchpoint, the first weight system configured to provide weight to the first upper weighted touchpoint;

a second upper weighted touchpoint coupled to the vertical housing and configured to allow the user to exercise a second arm of the user;

a second weight system coupled to the second upper weighted touchpoint, the second weight system configured to provide weight to the second upper weighted touchpoint;

a first lower weighted touchpoint coupled to the vertical housing and configured to allow the user to exercise a first leg of the user;

a third weight system coupled to the first lower weighted touchpoint, the third weight system configured to provide weight to the first lower weighted touchpoint;

a second lower weighted touchpoint coupled to the vertical housing and configured to allow the user to exercise a second leg of the user;

a fourth weight system coupled to the second lower weighted touchpoint, the fourth weight system configured to provide weight to the second lower weighted touchpoint, wherein each of the first, second, third, and fourth weight systems is a separate and independently adjustable weight system;

a user bench having a leg attachment configured to allow the user to exercise the first leg of the user and further configured to allow the user to exercise the second leg of the user, wherein the first lower weighted touchpoint and the second lower weighted touchpoint are configured to be coupled to the leg attachment; and a control system configured to:

cause the first weight system to provide a first weight to the first upper weighted touchpoint independent of each of the second, third, and fourth weight systems;

cause the second weight system to provide a second weight to the second upper weighted touchpoint independent of each of the first, third, and fourth weight systems;

cause the third weight system to provide a third weight to the first lower weighted touchpoint independent of each of the first, second, and fourth weight systems; and cause the fourth weight system to provide a fourth weight to the second lower weighted touchpoint independent of each of the first, second, and third weight systems.

2. The exercise system of claim 1, wherein the first upper weighted touchpoint and the first lower weighted touchpoint are configured to allow the user to exercise the first arm of the user and the first leg of the user simultaneously.

3. The exercise system of claim 1, wherein the first upper weighted touchpoint, the first lower weighted touchpoint, and the second lower weighted touchpoint are configured to allow the user to exercise the first arm of the user, the first leg of the user, and the second leg of the user simultaneously.

4. The exercise system of claim 1, wherein the first upper weighted touchpoint, the second upper weighted touchpoint, and the first lower weighted touchpoint are configured to allow the user to exercise the first arm of the user, the second arm of the user, and the first leg of the user simultaneously.

5. The exercise system of claim 1, wherein the first upper weighted touchpoint, the second upper weighted touchpoint, the first lower weighted touchpoint, and the second lower weighted touchpoint are configured to allow the user to exercise the first arm of the user, the second arm of the user, the first leg of the user, and the second leg of the user simultaneously.

6. The exercise system of claim 1, wherein the first upper weighted touchpoint is configured to allow the user to exercise only the first arm of the user.

7. The exercise system of claim 1, wherein the first lower weighted touchpoint is configured to allow the user to exercise only the first leg of the user.

8. The exercise system of claim 1, wherein the control system is further configured to:

randomly select the first weight;

randomly select the second weight;

randomly select the third weight; and randomly select the fourth weight.

9. The exercise system of claim 1, wherein the control system is further configured to:

receive, from the user, a selection of the first weight;

receive, from the user, a selection of the second weight;

receive, from the user, a selection of the third weight; and receive, from the user, a selection of the fourth weight.

10. The exercise system of claim 1, wherein the first, second, third, and fourth weights are all different weight amounts.

11. The exercise system of claim 1, wherein each of the first, second, third, and fourth weight systems is a screw and weights system, an actuated pin and weights system, an electromagnetic eddy current resistance system, a friction resistance system, or an active-compliance motor system.

12. A method, comprising:

determining, by a control system of an exercise system, a first weight and a second weight to be used by a user to exercise a first arm of the user and a first leg of the user simultaneously, wherein the exercise system comprises:

a first upper weighted touchpoint configured to allow the user to exercise the first arm of the user;

a first weight system coupled to the first upper weighted touchpoint and configured to provide weight to the first upper weighted touchpoint;

a second upper weighted touchpoint configured to allow the user to exercise a second arm of the user;

a second weight system coupled to the second upper weighted touchpoint and configured to provide weight to the second upper weighted touchpoint;

a first lower weighted touchpoint configured to allow the user to exercise the first leg of the user;

a third weight system coupled to the first lower weighted touchpoint and configured to provide weight to the first lower weighted touchpoint;

a second lower weighted touchpoint configured to allow the user to exercise a second leg of the user; and a fourth weight system coupled to the second lower weighted touchpoint and configured to provide weight to the second lower weighted touchpoint, wherein each of the first, second, third, and fourth weight systems is a separate and independently adjustable weight system;

following the determination of the first weight and the second weight to be used by the user to exercise the first arm of the user and the first leg of the user simultaneously:

causing, by the control system, the first weight system to provide the first weight to the first upper weighted touchpoint independent of each of the second, third, and fourth weight systems; and causing, by the control system, the third weight system to provide the second weight to the first lower weighted touchpoint independent of each of the first, second, and fourth weight systems; and allowing the user to utilize the first upper weighted touchpoint and the first lower weighted touchpoint simultaneously so as to exercise the first arm of the user and the first leg of the user simultaneously.

13. The method of claim 12, further comprising:

determining, by the control system, a third weight to be used by the user to exercise the first arm of the user, the first leg of the user, and the second arm of the user simultaneously;

following the determination of the third weight to be used by the user to exercise the first arm of the user, the first leg of the user, and the second arm of the user simultaneously, causing, by the control system, the second weight system to provide the third weight to the second upper weighted touchpoint independent of each of the first, third, and fourth weight systems; and allowing the user to utilize the second upper weighted touchpoint simultaneously with the first upper weighted touchpoint and the first lower weighted touchpoint so as to exercise the first arm of the user, the first leg of the user, and the second arm of the user simultaneously.

14. The method of claim 12, further comprising:

determining, by the control system, a third weight to be used by the user to exercise the first arm of the user, the first leg of the user, and the second leg of the user simultaneously;

following the determination of the third weight to be used by the user to exercise the first arm of the user, the first leg of the user, and the second leg of the user simultaneously, causing, by the control system, the fourth weight system to provide the third weight to the second lower weighted touchpoint independent of each of the first, second, and third weight systems; and allowing the user to utilize the second lower weighted touchpoint simultaneously with the first upper weighted touchpoint and the first lower weighted touchpoint so as to exercise the first arm of the user, the first leg of the user, and the second leg of the user simultaneously.

15. The method of claim 12, further comprising:

determining, by the control system, a third weight and a fourth weight to be used by the user to exercise the first arm of the user, the first leg of the user, the second arm of the user, and the second leg of the user simultaneously;

following the determination of the third weight and the fourth weight to be used by the user to exercise the first arm of the user, the first leg of the user, the second arm of the user, and the second leg of the user simultaneously:

causing, by the control system, the second weight system to provide the third weight to the second upper weighted touchpoint independent of each of the first, third, and fourth weight systems; and causing, by the control system, the fourth weight system to provide the fourth weight to the second lower weighted touchpoint independent of each of the first, second, and third weight systems; and allowing the user to utilize the second upper weighted touchpoint and the second lower weighted touchpoint simultaneously with the first upper weighted touchpoint and the first lower weighted touchpoint so as to exercise the first arm of the user, the first leg of the user, the second arm of the user, and the second leg of the user simultaneously.

16. The method of claim 12, wherein determining, by the control system of the exercise system, the first weight and the second weight to be used by the user to exercise the first arm of the user and the first leg of the user simultaneously comprises:

randomly selecting, by the control system, the first weight; and randomly selecting, by the control system, the second weight.

17. The method of claim 12, wherein determining, by the control system of the exercise system, the first weight and the second weight to be used by the user to exercise the first arm of the user and the first leg of the user simultaneously comprises:

receiving, by the control system from the user, a selection of the first weight; and receiving, by the control system from the user, a selection of the second weight.

18. The method of claim 12, wherein the first and second weights are different weight amounts.

19. The method of claim 12, wherein each of the first, second, third, and fourth weight systems is a screw and weights system, an actuated pin and weights system, an electromagnetic eddy current resistance system, a friction resistance system, or an active-compliance motor system.

* * * * *